US008443539B2

(12) United States Patent
Cabahug et al.

(10) Patent No.: US 8,443,539 B2
(45) **Date of Patent: *May 21, 2013**

(54) RAIL CONTACTS FOR ACCESSORIES MOUNTED ON THE POWERED RAIL OF A WEAPON

(75) Inventors: Eric F. Cabahug, Fairfax, VA (US); James S. Dodd, Linden, VA (US); Ben Feldman, Reston, VA (US); Don McLaughlin, Ashburn, VA (US); John Schroeder, Leesburg, VA (US); Hector Tapia, Ashburn, VA (US)

(73) Assignee: Prototype Productions Incorporated Ventures Two, LLC, Ashburn, VA (US)

( * ) Notice: Subject to any disclaimer, the term of this patent is extended or adjusted under 35 U.S.C. 154(b) by 0 days.
This patent is subject to a terminal disclaimer.

(21) Appl. No.: 13/075,880

(22) Filed: Mar. 30, 2011

(65) Prior Publication Data

US 2012/0131837 A1 May 31, 2012

Related U.S. Application Data

(63) Continuation-in-part of application No. 12/791,460, filed on Jun. 1, 2010, now Pat. No. 8,141,288, which is a continuation-in-part of application No. 12/689,437, filed on Jan. 19, 2010, now abandoned, and a continuation-in-part of application No. 12/689,436, filed on Jan. 19, 2010, and a continuation-in-part of application No. 12/689,430, filed on Jan. 19, 2010, now abandoned, and a continuation-in-part of application No. 12/689,438, filed on Jan. 19, 2010, and a continuation-in-part of application No. 12/689,440, filed on Jan. 19, 2010, and a continuation-in-part of application No. 12/689,439, filed on Jan. 19, 2010, now abandoned.

(60) Provisional application No. 61/183,250, filed on Jun. 2, 2009, provisional application No. 61/183,258, filed on Jun. 2, 2009, provisional application No. 61/145,248, filed on Jan. 16, 2009, provisional application No. 61/145,216, filed on Jan. 16, 2009, provisional application No. 61/145,232, filed on Jan. 16, 2009, provisional application No. 61/145,211, filed on Jan. 16, 2009, provisional application No. 61/145,222, filed on Jan. 16, 2009, provisional application No. 61/145,228, filed on Jan. 16, 2009.

(51) Int. Cl.
*F41C 23/00* (2006.01)

(52) U.S. Cl.
USPC ..... 42/85; 42/71.01; 42/72; 42/84; 42/75.03

(58) Field of Classification Search
USPC ..... 42/85, 71.01, 72, 84, 75.03
See application file for complete search history.

(56) References Cited

U.S. PATENT DOCUMENTS 4,533,980 A 8/1985 Hayes
5,033,219 A * 7/1991 Johnson et al. ..... 42/115

(Continued)

OTHER PUBLICATIONS

In the US Patent and Trademark Office U.S. Appl. No. 12/689,430 Non-Final Office Action dated Feb. 17, 2011, 4 pages.

(Continued)

*Primary Examiner* — Michelle Clement
(74) *Attorney, Agent, or Firm* — Patton Boggs LLP

(57) ABSTRACT

A firearm may have a plurality of power-consuming accessories that can be attached to the weapon. In order to reduce the weight of these power-consuming accessories, as well as the proliferation of their batteries, the Weapon Accessory Power Distribution System provides a common power source to power the power-consuming accessories attached to the weapon. One or more powered rails are provided to encircle the barrel of the weapon, to provide a point of mechanical and electrical interconnection for the power-consuming accessories to provide quick connect mounting and dismounting of the power-consuming accessory, absent the use of connectors with their tethering cables, which are susceptible to entanglement. The Weapon Accessory Rail Contacts provide the mechanism to electrically interconnect the power-consuming accessory with the powered rail.

10 Claims, 17 Drawing Sheets

U.S. PATENT DOCUMENTS

| | | | | |
|---|---|---|---|---|
| 5,142,806 | A | 9/1992 | Swan | |
| 5,360,949 | A * | 11/1994 | Duxbury | 174/250 |
| 5,669,174 | A | 9/1997 | Teetzel | |
| 5,822,905 | A | 10/1998 | Teetzel | |
| 5,826,363 | A | 10/1998 | Olson | |
| 6,237,271 | B1 | 5/2001 | Kaminski | |
| 6,618,976 | B1 | 9/2003 | Swan | |
| 6,622,416 | B2 | 9/2003 | Kim | |
| 6,925,744 | B2 * | 8/2005 | Kincel | 42/71.01 |
| 6,931,775 | B2 | 8/2005 | Burnett | |
| 7,144,830 | B2 * | 12/2006 | Hill et al. | 442/205 |
| 7,243,454 | B1 * | 7/2007 | Cahill | 42/72 |
| RE40,216 | E | 4/2008 | Swan | |
| 7,421,818 | B2 | 9/2008 | Houde-Walter | |
| 7,464,495 | B2 * | 12/2008 | Cahill | 42/72 |
| 7,525,203 | B1 | 4/2009 | Racho | |
| 7,548,697 | B2 | 6/2009 | Hudson et al. | |
| 7,559,169 | B2 | 7/2009 | Hung et al. | |
| 7,562,483 | B2 * | 7/2009 | Hines | 42/90 |
| 7,584,569 | B2 | 9/2009 | Kallio et al. | |
| 7,627,975 | B1 | 12/2009 | Hines | |
| 7,640,690 | B2 * | 1/2010 | Hines | 42/75.03 |
| 7,676,975 | B2 * | 3/2010 | Phillips et al. | 42/72 |
| 7,712,241 | B2 | 5/2010 | Teetzel et al. | |
| 7,818,910 | B2 * | 10/2010 | Young | 42/71.01 |
| 7,841,120 | B2 | 11/2010 | Teetzel et al. | |
| 7,866,083 | B2 | 1/2011 | Teetzel | |
| 7,975,419 | B2 * | 7/2011 | Darian | 42/84 |
| 8,001,715 | B2 * | 8/2011 | Stokes | 42/146 |
| 8,091,265 | B1 | 1/2012 | Teetzel et al. | |
| 2005/0241206 | A1 | 11/2005 | Teetzel et al. | |
| 2008/0010890 | A1 | 1/2008 | Vice et al. | |
| 2008/0039962 | A1 | 2/2008 | McRae | |
| 2008/0040965 | A1 | 2/2008 | Solinsky et al. | |
| 2008/0063400 | A1 | 3/2008 | Hudson et al. | |
| 2008/0134562 | A1 | 6/2008 | Teetzel | |
| 2008/0170838 | A1 * | 7/2008 | Teetzel et al. | 386/118 |
| 2008/0190002 | A1 * | 8/2008 | Hines | 42/1.06 |
| 2009/0044439 | A1 * | 2/2009 | Phillips et al. | 42/72 |
| 2009/0108589 | A1 * | 4/2009 | Racho | 290/1 R |
| 2009/0255160 | A1 * | 10/2009 | Summers | 42/70.01 |
| 2010/0031552 | A1 | 2/2010 | Houde-Walter | |
| 2010/0083553 | A1 | 4/2010 | Montgomery | |
| 2010/0192443 | A1 * | 8/2010 | Cabahug et al. | 42/71.02 |
| 2010/0192444 | A1 * | 8/2010 | Cabahug et al. | 42/71.02 |
| 2010/0192446 | A1 | 8/2010 | Darian | |
| 2010/0192448 | A1 | 8/2010 | Darian | |
| 2010/0218410 | A1 * | 9/2010 | Cabahug et al. | 42/71.01 |
| 2010/0242332 | A1 | 9/2010 | Teetzel et al. | |
| 2011/0000120 | A1 | 1/2011 | Thompson | |
| 2011/0010979 | A1 | 1/2011 | Houde-Walter | |
| 2011/0126622 | A1 | 6/2011 | Turner | |
| 2011/0162251 | A1 * | 7/2011 | Houde-Walter | 42/146 |
| 2011/0173865 | A1 * | 7/2011 | Compton et al. | 42/84 |

OTHER PUBLICATIONS

Third Party Submission by Michael B. Brooks dated May 12, 2011.
In the US Patent and Trademark Office U.S. Appl. No. 12/689,436 Non-Final Office Action dated Oct. 5, 2011, 4 pages.
In the US Patent and Trademark Office U.S. Appl. No. 12/689,437 Non-Final Office Action dated Oct. 6, 2011, 10 pages.
In the US Patent and Trademark Office U.S. Appl. No. 12/689,438 Non-Final Office Action dated Oct. 11, 2011, 9 pages.
In the US Patent and Trademark Office U.S. Appl. No. 12/689,440 Final Office Action dated Apr. 12, 2012, 14 pages.
In the US Patent and Trademark Office U.S. Appl. No. 12/689,440 Non-Final Office Action dated Oct. 7, 2011, 10 pages.
In the US Patent and Trademark Office U.S. Appl. No. 12/791,460 Non-Final Office Action dated Oct. 6, 2011, 6 pages.
In the US Patent and Trademark Office U.S. Appl. No. 12/950,979 Non-Final Office Action dated Oct. 5, 2011, 11 pages.
In the US Patent and Trademark Office U.S. Appl. No. 13/075,837 Non-Final Office Action dated Dec. 20, 2011, 8 pages.
In the US Patent and Trademark Office U.S. Appl. No. 13/075,857 Non-Final Office Action dated Jan. 11, 2012, 10 pages.
In the US Patent and Trademark Office U.S. Appl. No. 13/370,629 Non-Final Office Action dated Mar. 29, 2012, 7 pages.
In the US Patent and Trademark Office U.S. Appl. No. 12/689,438, Final Office Action dated Jul. 19, 2012, 9 pages.
In the US Patent and Trademark Office U.S. Appl. No. 13/075,837, Final Office Action dated Jul. 12, 2012, 5 pages.
In the US Patent and Trademark Office U.S. Appl. No. 13/075,837, Final Office Action dated Dec. 26, 2012, 3 pages.
In the US Patent and Trademark Office U.S. Appl. No. 13/075,837, Final Office Action dated Jul. 19, 2012, 13 pages.

* cited by examiner

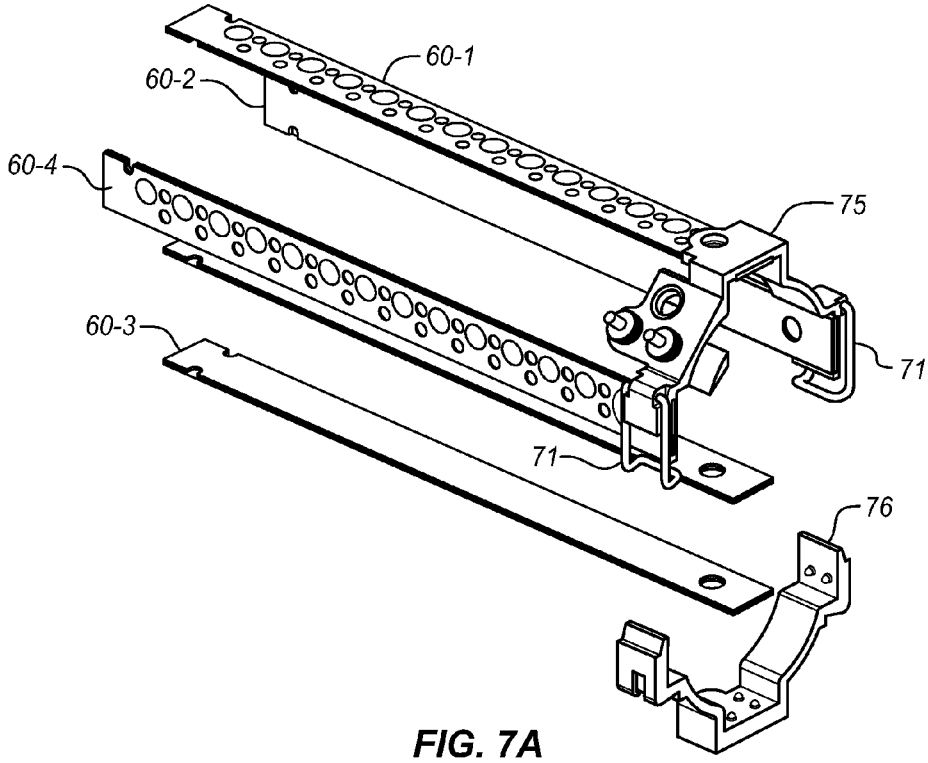
FIG. 7A
FIG. 7B
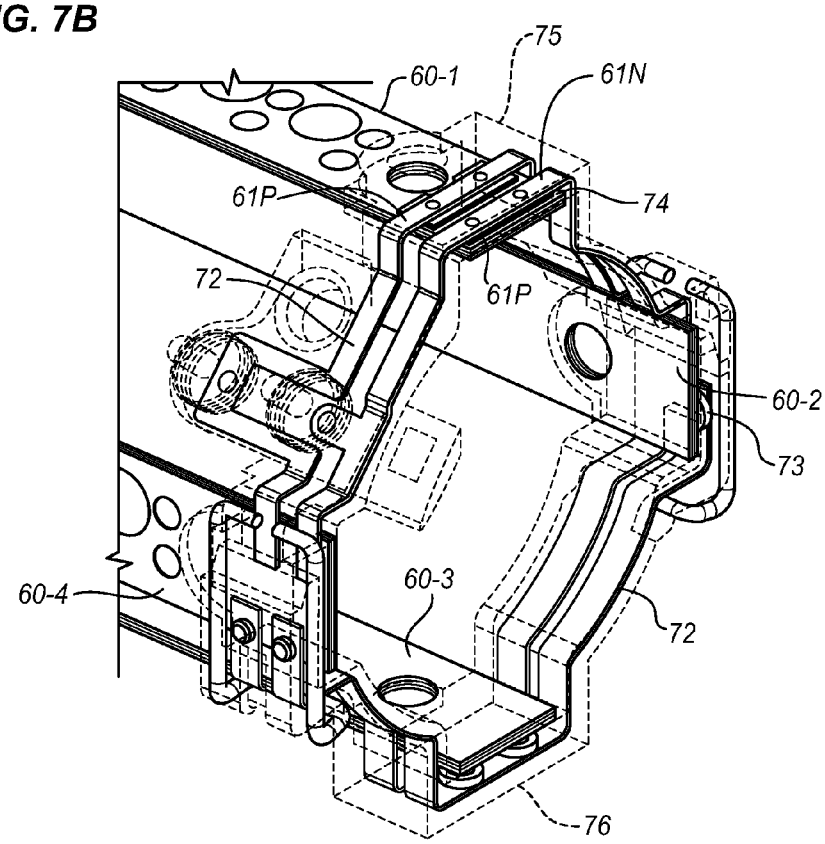

RAIL CONTACTS FOR ACCESSORIES MOUNTED ON THE POWERED RAIL OF A WEAPON

CROSS-REFERENCE TO RELATED APPLICATIONS

This application is a continuation-in-part of U.S. patent application Ser. No. 12/791,460 filed on Jun. 1, 2010, titled "Rugged Low Light Reflectivity Electrical Contact," which claims the benefit of U.S. Provisional Patent Application Ser. No. 61/183,250 filed on Jun. 2, 2009, titled "Non-Reflective, Conductive Mesh, Environmentally Robust Electrical Contacts." This application is also a continuation-in-part of U.S. patent application Ser. No. 12/689,439 filed on Jan. 19, 2010, titled "Rifle Accessory Rail, Communication, And Power Transfer System—Power Distribution," which claims the benefit of U.S. Provisional Patent Application Ser. No. 61/145,228 filed on Jan. 16, 2009; U.S. patent application Ser. No. 12/689,430 filed on Jan. 19, 2010, titled "Rifle Accessory Rail, Communication, And Power Transfer System," which claims the benefit of U.S. Provisional Patent Application Ser. No. 61/145,232 filed on Jan. 16, 2009; U.S. patent application Ser. No. 12/689,436 filed on Jan. 19, 2010, titled "Accessory Mount For Rifle Accessory Rail, Communication, And Power Transfer System—Accessory Attachment," which claims the benefit of U.S. Provisional Patent Application Ser. No. 61/145,216 filed on Jan. 16, 2009; U.S. patent application Ser. No. 12/689,437 filed on Jan. 19, 2010, titled "Rifle Accessory Rail, Communication, And Power Transfer System—Communication," which claims the benefit of U.S. Provisional Patent Application Ser. No. 61/145,248 filed on Jan. 16, 2009; U.S. patent application Ser. No. 12/689,438 filed on Jan. 19, 2010, titled "Rifle Accessory Rail, Communication, And Power Transfer System—Battery Pack," which claims the benefit of U.S. Provisional Patent Application Ser. No. 61/145,211 filed on Jan. 16, 2009; and U.S. patent application Ser. No. 12/689,440 filed on Jan. 19, 2010, titled "Rifle Accessory Rail, Communication, And Power Transfer System—Rail Contacts," which claims the benefit of U.S. Provisional Patent Application Ser. No. 61/145,222 filed on Jan. 16, 2009. This application also is related to the U.S. Patent Application titled "Communication And Control Of Accessories Mounted On The Powered Rail Of A Weapon" and the U.S. Patent Application titled "System For Providing Electrical Power To Accessories Mounted On The Powered Rail Of A Weapon," both of which are filed concurrently herewith. The foregoing applications are hereby incorporated by reference to the same extent as though fully disclosed herein.

STATEMENT REGARDING FEDERALLY SPONSORED RESEARCH OR DEVELOPMENT

This application is sponsored by the US Department of Defense under Contract Numbers W15QKN-08-C-0072 and W15QKN-09-C-0045.

FIELD OF THE INVENTION

The invention relates generally to the field of electrical power distribution and, more particularly, to electrical contacts for use with a powered rail of a weapon to provide electric power to power-consuming accessories mounted on the powered rail.

BACKGROUND OF THE INVENTION

It is a problem to reliably provide electric power to power-consuming accessories which are mounted on a weapon in an environmentally hostile environment. The typical adverse natural environment includes, but is not limited to, corrosion, chemical contamination, extreme temperatures, humidity, rain, dirt, ice, and abrasion. The traditional approach is to have each power-consuming accessory completely self-contained, each with its own batteries. However, the weight of the batteries in all of the power-consuming accessories creates an imbalance in the weapon and adds a significant amount of weight to the weapon. That, coupled with the cost of provisioning numerous types of batteries renders self-contained accessories a poor choice.

Therefore, the provision of a common power source is a preferred solution. The common power source must have a method of electrically connecting to the power-consuming accessory which is operationally associated with the weapon. There are two modes of electrically interconnecting two or more circuit elements together. One mode of electrical interconnection is to hardwire the circuit elements together, which renders the resultant apparatus a unitary structure. The second mode of electrical interconnection is to use one or more electrical contacts to interconnect the circuit elements, thereby enabling the circuit elements to be removably attached to each other and/or to a power source. The electrical contacts are either mounted on mating surfaces of two elements, coming into contact when the two elements are juxtaposed to each other and mechanically forced together, or mounted in connectors, which are electrically tethered to the respective elements via cables, and joined together via locking connector shells which house the respective set of mating electrical contacts and protect the respective sets of contacts from the ambient environment.

The use of electrical contacts mounted on mating surfaces of two elements is optimal for quick connect applications, but these contacts are susceptible to contamination, which degrades performance. The exposed contacts, therefore, must be manufactured from a material that provides low resistivity (such as gold) even when exposed to the hostile ambient environment.

To protect electrical contacts from hostile ambient environmental conditions, such as outdoor applications, the electrical contacts typically are housed in a weatherproof housing, such as a connector shell or a weatherproof sealed box. However, the tethering electrical cable and the connector shell are significantly more expensive than the use of electrical contacts mounted on mating surfaces of two elements, although they provide greater protection from the environment, but are also less convenient for quick connect applications.

However, these technologies fail to provide a user with control over the operation of the power-consuming accessories, since they simply provide electrical connection to the power source and must rely on a power switch mounted on each power-consuming accessory to enable the user to apply power in a binary, on/off manner to that power-consuming accessory. The need to operate such a switch on a power-consuming accessory is inconvenient and prevents the user from having the ability to rapidly power-up and power-down the power-consuming accessory. In the case of a plurality of power-consuming accessories being mounted on the weapon, such a power control method is cumbersome at best.

BRIEF SUMMARY OF THE INVENTION

The above-described problems are solved and a technical advance achieved by the present Rail Contacts For Accessories Mounted On The Powered Rail Of A Weapon (termed "Weapon Accessory Rail Contacts" herein) which is adapted for use in weapons, such as military weapons. A firearm used in military applications may have a plurality of accessories that can be attached to the weapon, with each accessory having a need for electric power. In order to reduce the weight of these power-consuming accessories, as well as the proliferation of batteries used to power these power-consuming accessories, a common power source is used to power whatever power-consuming accessory is attached to the weapon. A Weapon Accessory Power Distribution System provides one or more powered rails to provide a point of mechanical and electrical interconnection for the power-consuming accessories to provide quick connect mounting and dismounting of the power-consuming accessory, absent the use of connectors with their tethering cables, which are susceptible to entanglement. The powered rail(s) are electrically interconnected with a power source, which typically is a battery mounted in the butt stock of the weapon. Weapon Accessory Rail Contacts are provided to electrically interconnect the power-consuming accessory with the powered rail.

The following description provides a disclosure of the Weapon Accessory Power Distribution System in sufficient detail to understand the teachings and benefits of the Weapon Accessory Rail Contacts, which is delimited by the appended claims.

BRIEF DESCRIPTION OF THE DRAWINGS

FIGS. 6A and 6B are plan and perspective views, respectively, of two implementations of the printed circuit board used to implement the Powered Rail, while

FIGS. 7A and 7B illustrate the details of the Powered Rail electrical interconnection;

DETAILED DESCRIPTION OF THE PREFERRED EMBODIMENT

Definitions

Contact—One-half of a Contact Pair consisting of an electrically conductive surface which is electrically connected to a power source or power-consuming device.

Contact Pair—A set of two Contacts which, when brought together in mechanical contact, complete an electrical circuit enabling the transfer of electrical power and/or electrical signals therebetween.

Visible Spectrum—The visible spectrum is the portion of the electromagnetic spectrum that is visible to (can be detected by) the human eye. Electromagnetic radiation in this range of wavelengths is called "visible light" or simply "light". A typical human eye responds to wavelengths from about 390 nm to 750 nm. In terms of frequency, this corresponds to a band in the vicinity of 400 THz to 790 THz.

Electrical Resistivity—Electrical Resistivity is a measure of how strongly a material opposes the flow of electric current. A low resistivity indicates a material that readily allows the movement of electrical charge.

Electrical Conductivity—Electrical Conductivity (the inverse of Electrical Resistivity) is a measure of how strongly a material supports the flow of electric current. A high conductivity indicates a material that readily allows the movement of electrical charge.

Picatinny Rail

It is well known to those skilled in the art that rapid fire firearms, utilized particularly in military operations, are characterized by the heating of the barrel of the weapon to relatively high temperatures. At such temperatures, the barrel cannot be held safely by the person firing the weapon. Consequently, a variety of handguards have been developed to shroud the barrel of such rapid fire weapons to enable the person firing the weapon to grip the forward portion of the weapon while mitigating the possibility of burning the hand of the person firing the weapon, yet also providing adequate cooling for the barrel of the weapon.

Figure 1A:
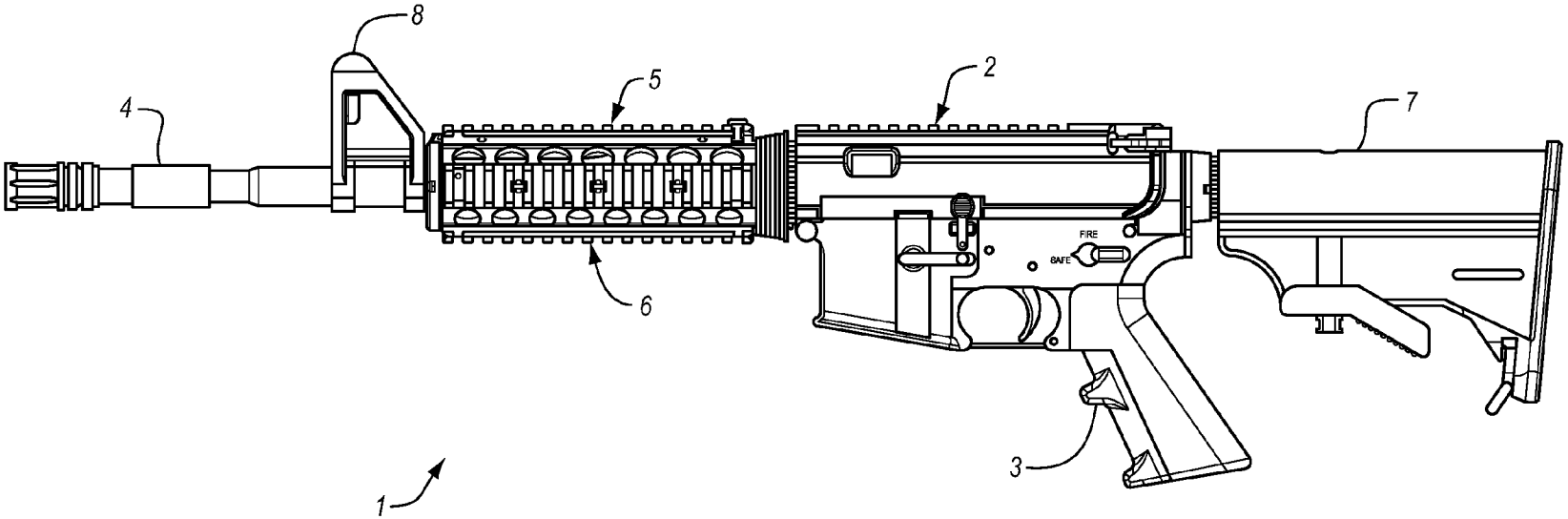
FIG. 1A PRIOR ART
FIGS. 1A-1C are illustrations of the prior art Picatinny Rail mounted on a military style weapon, which is used to mount accessories to the weapon as is well known in the art.
Figure 1B:
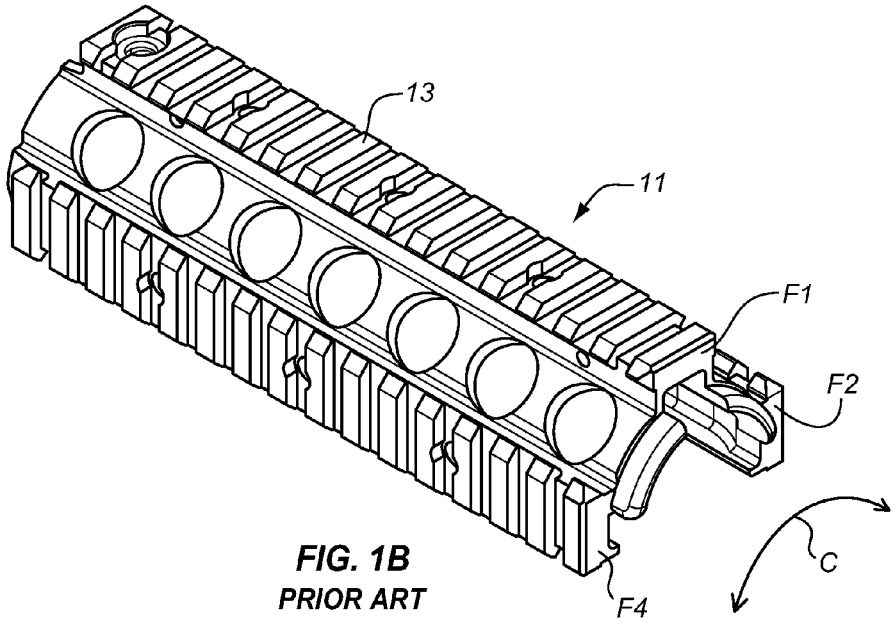
FIG. 1B PRIOR ART
Figure 1C:
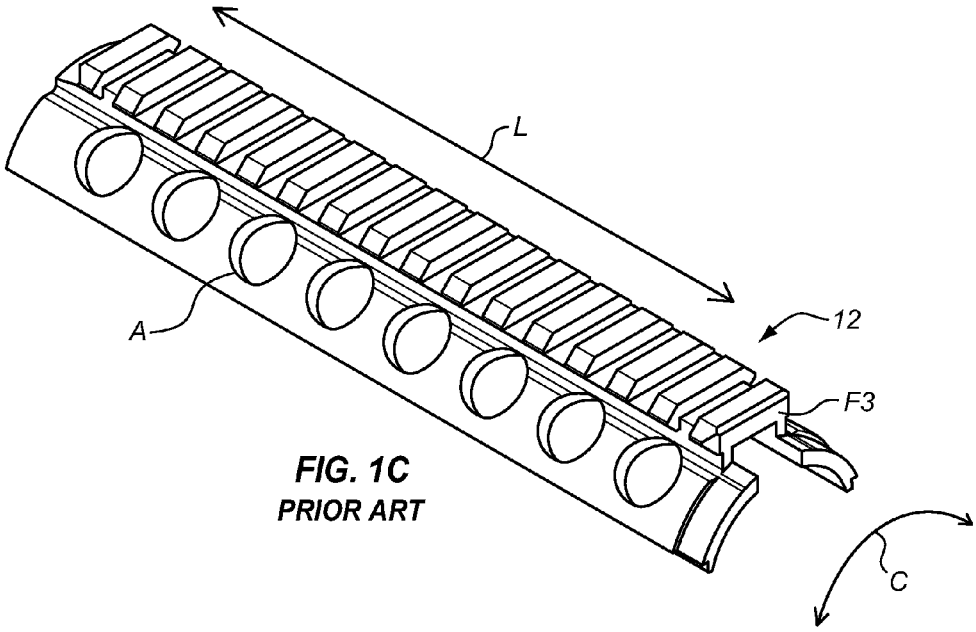
FIG. 1C PRIOR ART

FIGS. 1A-1C are illustrations of the prior art Picatinny Rail mounted on a military style weapon 1, which is used to mount accessories to the weapon as is well known in the art. The weapon 1 contains the standard components, such as receiver 2, grip 3, barrel 4, handguard 5, 6, butt stock 7, and front sight 8. The Picatinny Rail or MIL-STD-1913 rail (and NATO equivalent—STANAG 4694) is a bracket used on some firearms to provide a standardized accessory mounting platform. Its name comes from the Picatinny Arsenal in New Jersey, USA where it was originally tested and was used to distinguish it from other rail standards at the time. The Picatinny Rail comprises a series of ridges with a T-shaped cross-section interspersed with flat "locking slots" (also termed "recoil groove"). Scopes are mounted either by sliding them on from one end of the Picatinny Rail or the other end of the Picatinny Rail by means of a "rail-grabber" which is clamped to the Picatinny Rail with bolts, thumbscrews, or levers, or onto the slots between the raised sections.

With particular reference to FIGS. 1A-1C, the Picatinny Rail is shown as integrated into handguard 5, 6, which includes a top semi-cylindrical (C) part 11 and a bottom semi-cylindrical (C) part 12. The top semi-cylindrical part 11 is defined by a back end having a back end ledge that engages with a slip ring and a front end having a front end ledge that engages with the receptor cap to retain the part 11 about the barrel 4. Similarly, the bottom part 12 is defined by a back end having a back end ledge that engages with the slip ring and a front end having a front end ledge that engages with the receptor cap to retain the part 12 about the barrel 4. An accessory adapter rail 13 extends longitudinally and upwardly from the top semi-cylindrical part 11. The handguard 5, 6 may also include accessory adapter side rails and accessory adapter bottom rails. Thus, the Picatinny Rail is formed of a multi-faceted (F1-F4) structure, on each facet of which accessories can be mounted. Apertures A are provided along the length dimension L of the Picatinny Rail to enable the barrel 4 of the weapon 1 to be cooled by air circulation from the ambient environment.

The Picatinny Rail was originally designed for use with scopes. However, once established, the use of the Picatinny Rail was expanded to other accessories, such as tactical lights, laser aiming modules, night vision devices, reflex sights, fore grips, bipods, and bayonets. Because the Picatinny Rail was originally designed and used for telescopic sights, the rails were first used only on the receivers of larger caliber rifles. However, their use has extended to the point that Picatinny Rails and accessories have replaced iron sights in the design of many firearms, and they are also incorporated into the undersides of semi-automatic pistol frames and even on grips.

In order to provide a stable platform, the rail should not flex as the barrel heats and cools; this is the purpose of the locking slots: they give the rail considerable room to expand and contract lengthwise without distorting its shape.

Powering the multitude of accessories used on weapons equipped with the Picatinny Rail has been accomplished by equipping each accessory with its own set of batteries. A significant problem with this paradigm is that multiple types of batteries are used for accessories, thereby requiring an extensive inventory of replacements. In addition, the batteries, especially on high-power accessories, add significant weight to the barrel end of the weapon, adding strain to the user of the weapon to hold the barrel "on target" in an "off-hand manner" without support for the barrel.

Reticle Illumination

One example of an accessory for a weapon is a scope which includes a reticle which can be illuminated for use in low light or daytime conditions. The reticle is a grid of fine lines in the focus of the scope, used for determining the position of the target. With any illuminated low light reticle, it is essential that its brightness can be adjusted. A reticle that is too bright causes glare in the operator's eye, interfering with his ability to see in low light conditions. This is because the pupil of the human eye closes quickly upon receiving any source of light. Most illuminated reticles provide adjustable brightness settings to adjust the reticle precisely to the ambient light. Illumination is usually provided by a battery powered LED, though other electric light sources can be used. The light is projected forward through the scope and reflects off the back surface of the reticle. Red is the most common color used, as it least impedes the shooter's night vision. This illumination method can be used to provide both daytime and low light conditions reticle illumination.

Other examples of powered accessories include, but are not limited to: tactical lights, laser aiming modules, and night vision devices.

Weapon Equipped with Weapon Accessory Power Distribution System

Figure 2A:
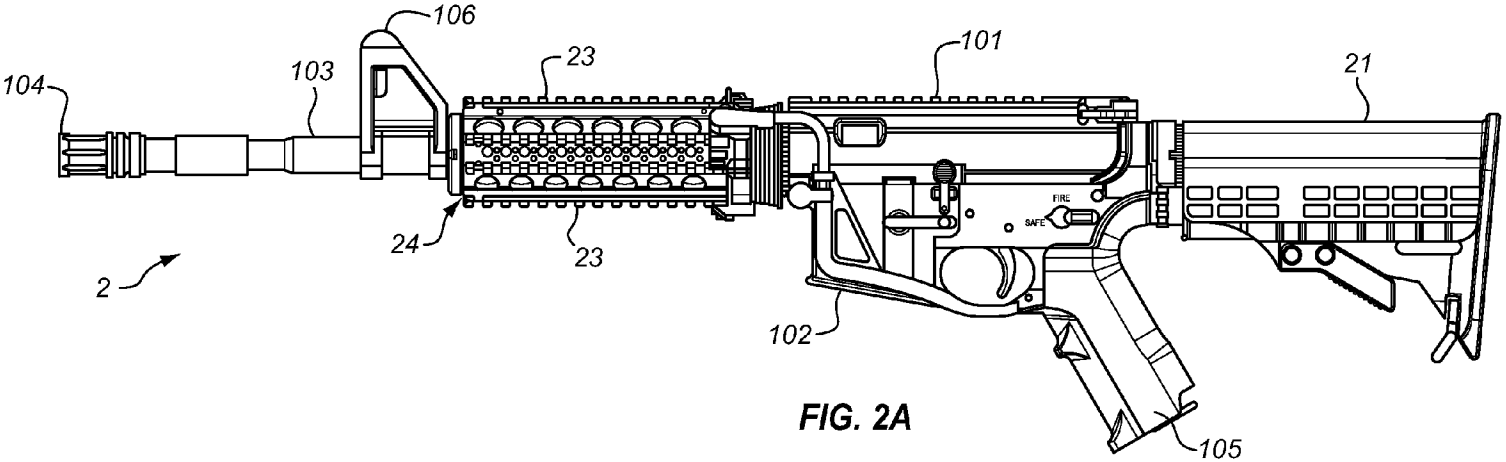
FIGS. 2A and 2B are illustrations of the system architecture of a military style weapon equipped with a Weapon Accessory Power Distribution System.
Figure 2B:
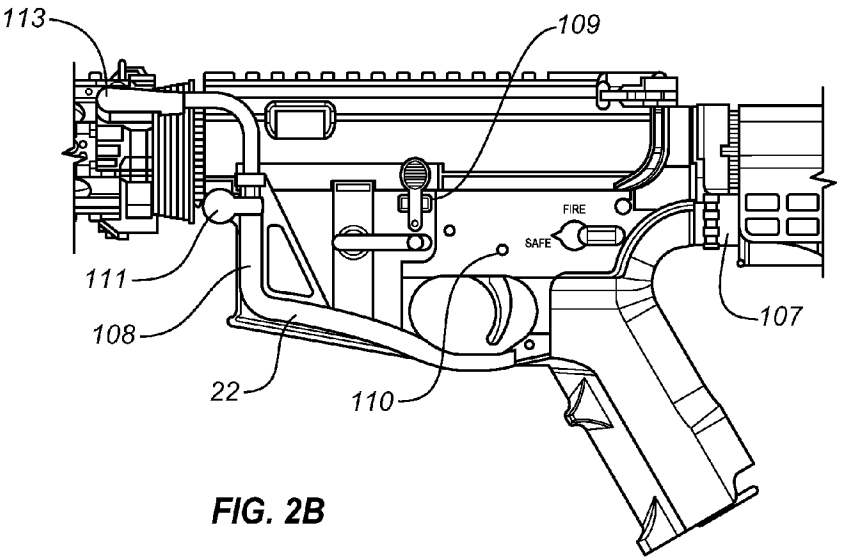

FIGS. 2A and 2B are illustrations of the system architecture of a military style weapon 2 equipped with a Weapon Accessory Power Distribution System. The primary components of the basic Weapon Accessory Power Distribution System as noted above are:

- Butt Stock 21 with Battery Pack 33 (shown in FIG. 3A);
- Power Distribution System 22;
- Handguard 23 (optional);
- Powered Rail 24; and
- Powered Accessory Mounting 25 (shown in FIG. 8A) and Weapon Accessory Rail Contacts (shown in FIGS. 8B-8K).

The existing weapon 2 includes in well-known fashion an upper receiver 101, lower receiver 102, barrel 103, muzzle 104, grip 105, and front sight 106. While a military-style weapon is described herein, the teachings of this application are equally applicable to other firearms, such as handguns, fixed-mount machine guns, as well as non-weapon based systems. The Weapon Accessory Power Distribution System is added to this standard military-style weapon 2 as described herein.

The Handguard 23 performs the barrel shielding function as in the Picatinny Rail noted above, but has been modified, as shown in FIGS. 2A and 2B, to accommodate the Powered Rail 24 and electrical interconnection of the Powered Accessory Mounting 25 to the Powered Rail 24, as described below. In particular, a combination of Powered Rails 24 and Handguard sections 23 are attached together to form a structure which encircles the barrel 103. The Powered Rails 24 in effect form facets around the periphery of the resultant Handguard structure. Thus, herein the term "Handguard" is used to represent the sections of handguard structure as well as the well-known combination of Handguard sections and Powered Rails which encircle the barrel 103 as shown in FIGS. 2A and 2B. As alternative structures, the Powered Rail 24 can be attached to a Handguard 23 that encircles the barrel. Furthermore, there is no requirement to use the Handguard 23 as an integral component of the Weapon Accessory Power Distribution System, so the Handguard 23 can be optional, with the Powered Rail(s) 24 being attached to the weapon in some other manner, such as an upper receiver rail 101 in FIG. 2A. For the purpose of illustrating the Weapon Accessory Control System, the first of the above-listed configurations is used herein.

Handguard

As noted above, the Handguard 23 was developed to shroud the barrel 103 of a rapid fire weapon 2 to enable the person firing the weapon 2 to grip the forward portion of the weapon 2 while mitigating the possibility of burning the hand of the person firing the weapon 2, yet also providing adequate cooling for the barrel 103 of the weapon. Handguards find application in rifles, carbines, and fixed-mount weapons, such as machine guns. However, the Weapon Accessory Power Distribution System can also be used in modified form for handguns, as an accessory mounting platform and as an accessory power source.

Figure 5A:
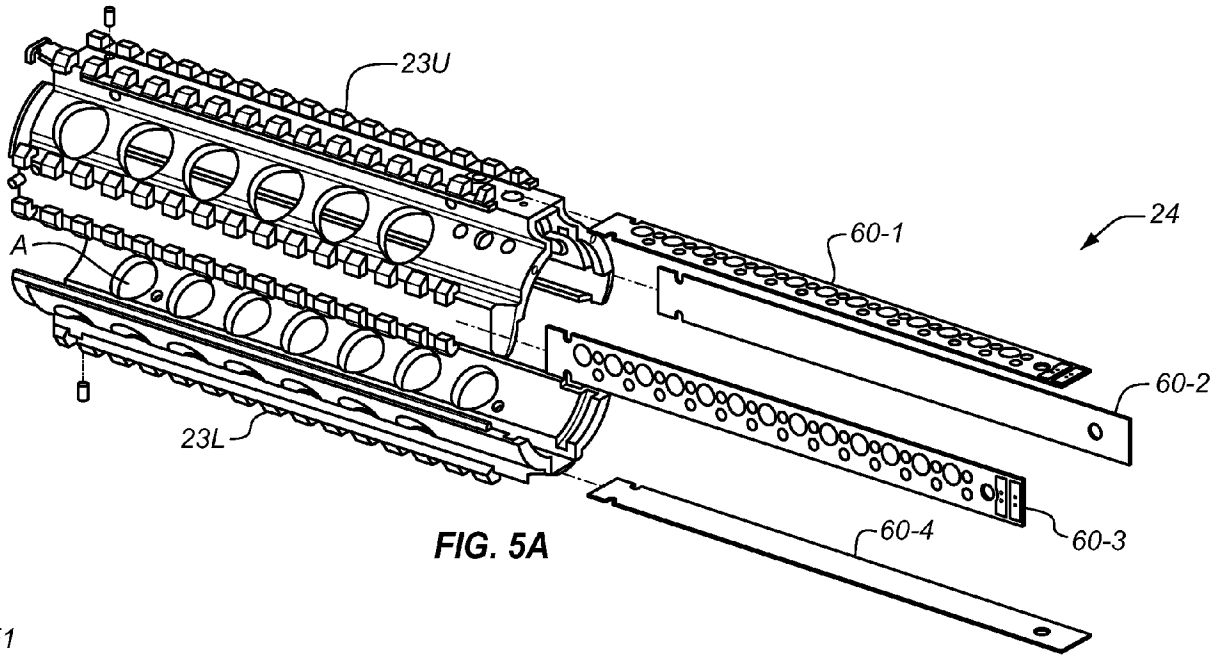
FIGS. 5A-5C are illustrations of the Handguard assembly, including the Powered Rail, of the Weapon Accessory Power Distribution System.
Figure 5B:
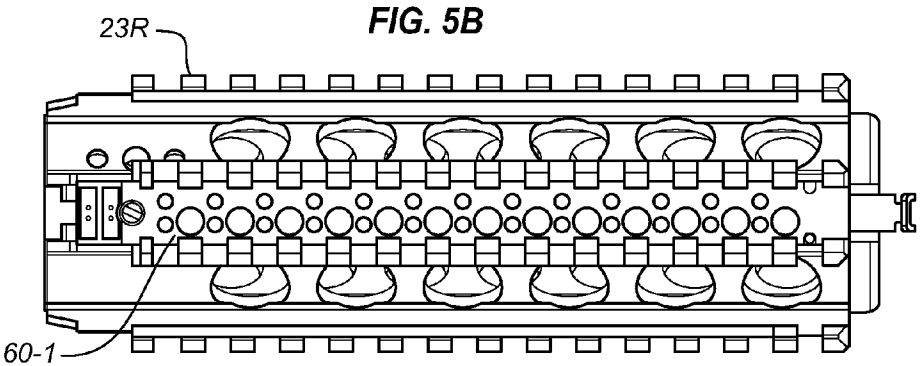
Figure 5C:
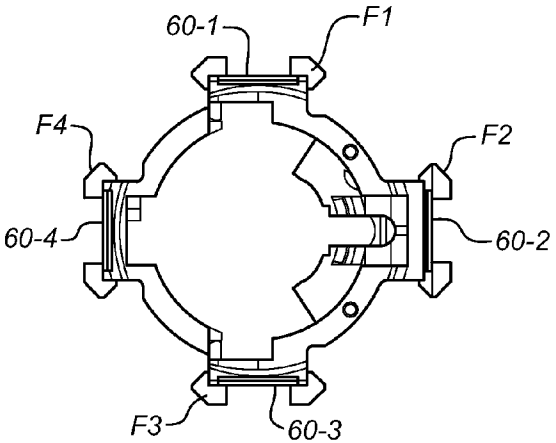

FIGS. 5A-5C are perspective exploded view, side view, and end view illustrations, respectively, of the Handguard 23 assembly, including the Powered Rail 24, of the Weapon Accessory Power Distribution System. The Powered Rail 24, as shown as an example, includes a series of ridges with a T-shaped cross-section interspersed with flat "spacing slots". This version of the Handguard 23, therefore, can be viewed as an adaptation of the existing non-powered Picatinny Rail which involves milling slots along the length of the mechanical accessory attachment points 23R in the upper Handguard section (23U) and the lower Handguard section (23L) in order to install one or more power distribution Printed Circuit Boards 60-1 to 60-4, with FIG. 5C showing an end view of the slots formed in the various facets F1-F4 of the Handguard 23. As with the Picatinny Rail, Apertures A are provided along the length dimension L of the Handguard 23 to enable the barrel 103 of the weapon 2 to be cooled by air circulation from the ambient environment. Other Powered Rail configurations are possible, and this architecture is provided as an illustration of the concepts of the Weapon Accessory Power Distribution System.

One or more of the Powered Rail subassemblies (typically Printed Circuit Boards) 60-1 to 60-4 can be inserted into the respective slots formed in the Powered Rail 24 (on the corresponding facets F1-F4 of the Handguard 23) thereby to enable power-consuming accessories to be attached to the Handguard 23 of the weapon 2 via the Powered Rail 24 on any facet F1-F4 of the Handguard 23 and to be powered by the corresponding Printed Circuit Board 60-1 to 60-4 installed in the Powered Rail 24 on that facet.

Battery Pack

Figure 3A:
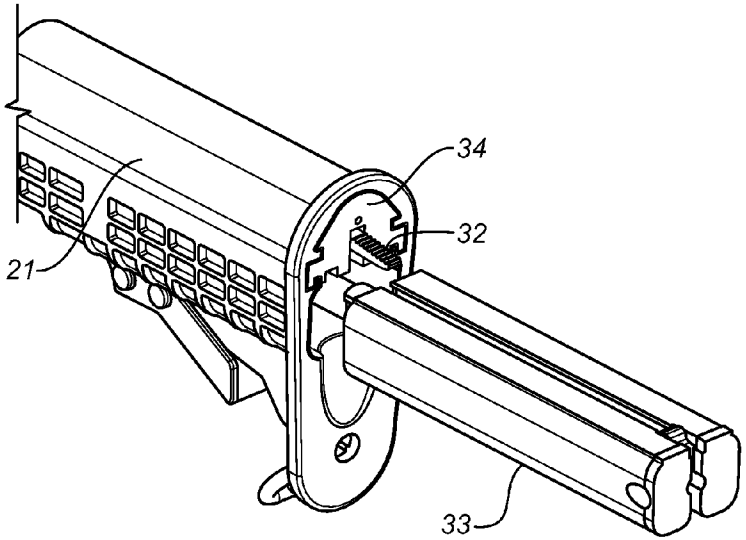
FIGS. 3A and 3B are illustrations of a typical butt stock battery pack of the Weapon Accessory Power Distribution System.
Figure 3B:
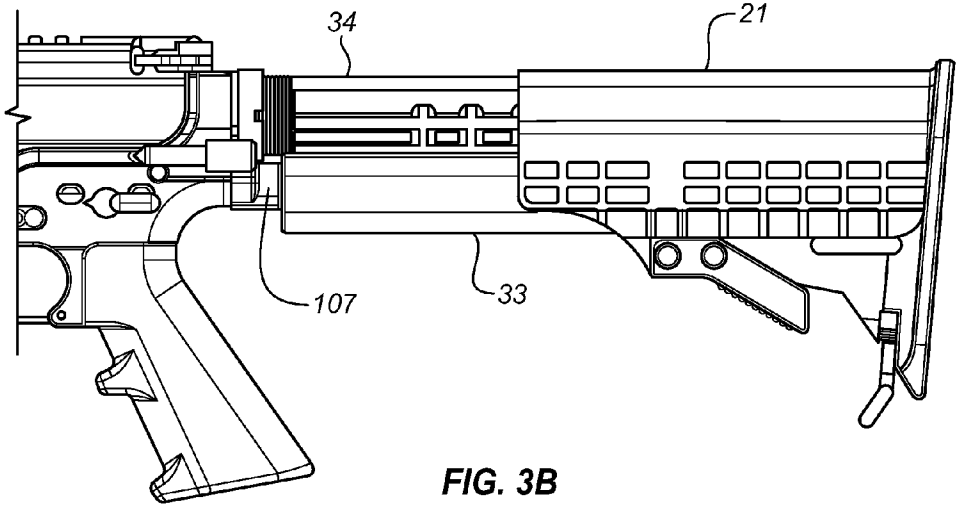
Figure 4A:
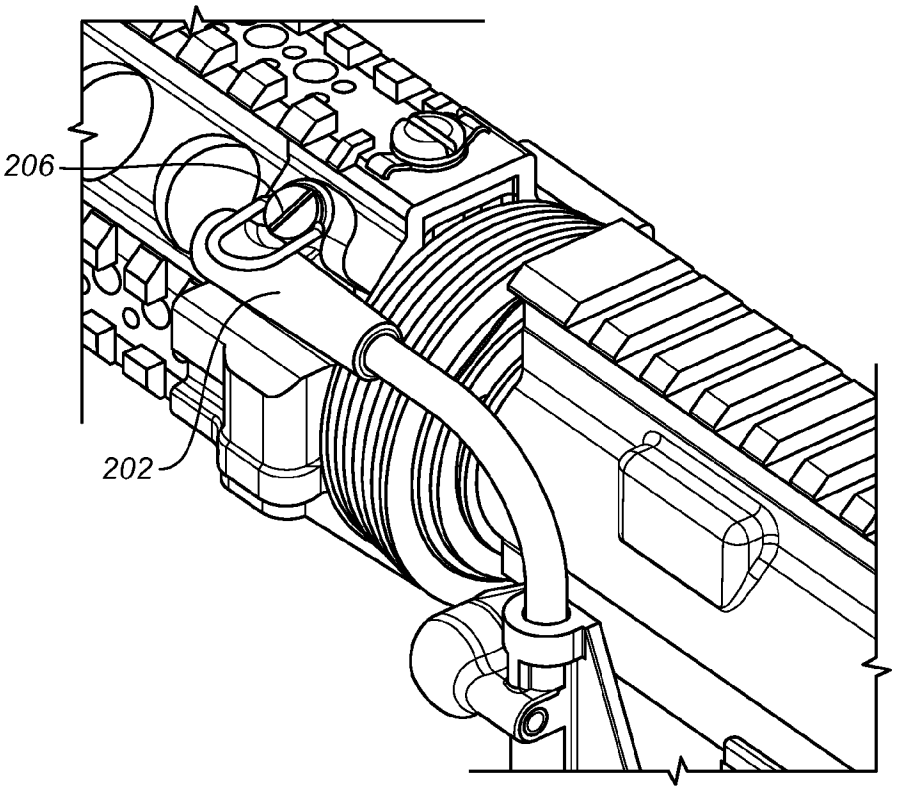
FIGS. 4A-4C are illustrations of the Power Distribution System which interconnects the Battery Pack to the Powered Rail in the Weapon Accessory Power Distribution System.
Figure 4B:
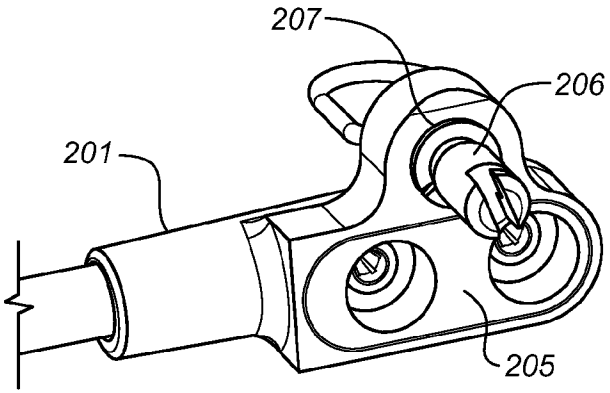
Figure 4C:
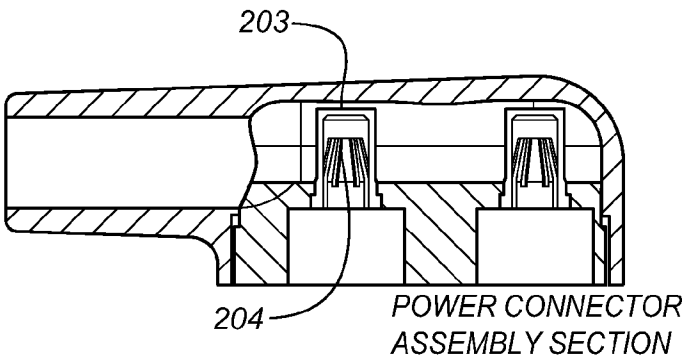

The Battery Pack can be implemented in a number of assemblies and mounted on various portions of the weapon (such as on the Powered Rail, or in a pistol grip, or in a remote power source, and the like) as described in the above-noted U.S. patent application Ser. No. 12/689,438 filed on Jan. 19, 2010, titled "Rifle Accessory Rail, Communication, And Power Transfer System—Battery Pack". For the purpose of this description, FIGS. 3A and 3B are illustrations of a typical Butt Stock 21 with Battery Pack 33 of the Weapon Accessory Power Distribution System. For example, a butt stock/recoil tube battery pack assembly includes an adjustable butt stock 21, a cam latch 32, and a removable battery pack 33. The butt stock 21 adds a compartment to the underside of the existing lower receiver extension (also termed "buffer tube" herein) assembly 34 which allows the battery pack 33 to be installed and withdrawn for removal through the rear of the rifle. The battery pack 33 mounts on the buffer tube assembly 34 independent of the butt stock 21 which telescopes along the rifle. The butt stock 21 is adjustable and can be extended in various multiple intermediate positions to provide an adjustable length of the firearm, as is well known in the art. By moving the mass of the battery rearward on the weapon, the time required to bring the weapon to point is reduced, as well as the time needed to "stop" the muzzle when the target is acquired.

Power Distribution System

The Power Distribution System 22 is shown in FIGS. 2A, 2B, and 4A-4C as a one-piece housing 201 and ruggedized power rail connector 202 where sealing integrity is maintained during exposure to adverse environmental conditions. The power rail connector 202 consists of a metallic shell body, contact pin receptacle 203, with a press fit multi-finger finger spring contact 204 assembled into the contact pin receptacle 203. The multi-finger spring contact 204 provides compliance to variations in the mating pin to ensure continuous current carrying capacity of the connection. The contact pin receptacle 203 includes a solder tail portion for soldering cable wires. The bottom panel insulator 205 mounts the pin receptacles 203 with the bottom part and fitted over the connector contact pin receptacle 203 and is sealed with a sealing compound. A fastener 206 and retaining ring 207 are used to secure the connector assembly into the rail pin contacts.

An electric wire is routed from the Battery Pack 33 in the Butt Stock 21 to the Powered Rail 24. The external wiring is housed inside a durable and impact resistant polymer shroud 108 that conforms to the lower receiver 102. The shroud is securely retained by a quick connect/disconnect pivot and takedown pin 111 as well as the bolt release roll pin 109 in the trigger/hammer pins 110. The shrouded power cable runs from the Battery Power Connector 107 at the Battery Pack 33 to the Power Rail Connector 202. This design provides an easy access for replacing or repairing the cable assembly, eliminates snag hazards or interferences with the rifle operation, and requires no modifications to the rifle lower receiver 102 housing.

Powered Rail

The Powered Rail 24 is used to electrically interconnect a power source (Battery Pack 33) with the various accessories mounted on the Powered Rail 24, such that the Powered Rail 24 of the Handguard 23 provides the mechanical support for the accessory and the Powered Rail 24 also provides the electrical interconnection. In this example, the Powered Rail 24 is attached to and coextensive with the Handguard 23 sections, such that the mounting of a Power-Consuming Accessory on the Powered Rail 24 results in simultaneous mechanical and electrical interconnection.

Figure 6A:
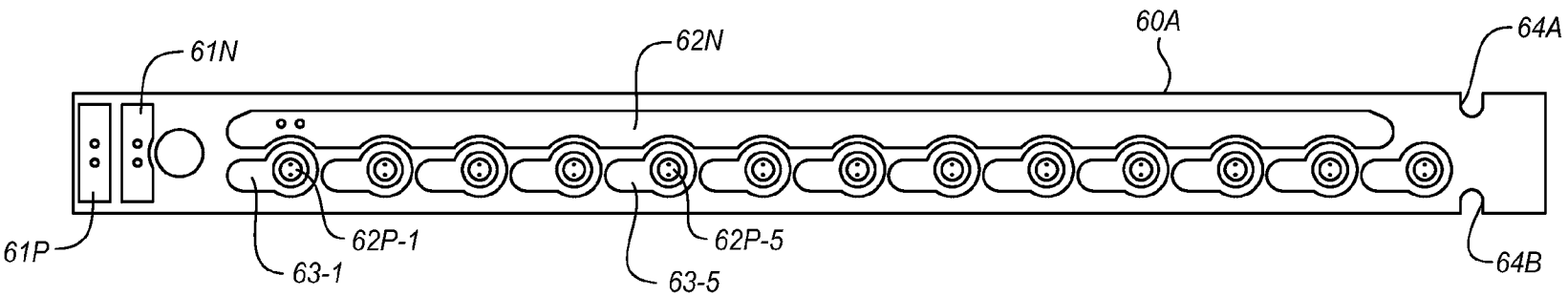
Figure 6B:
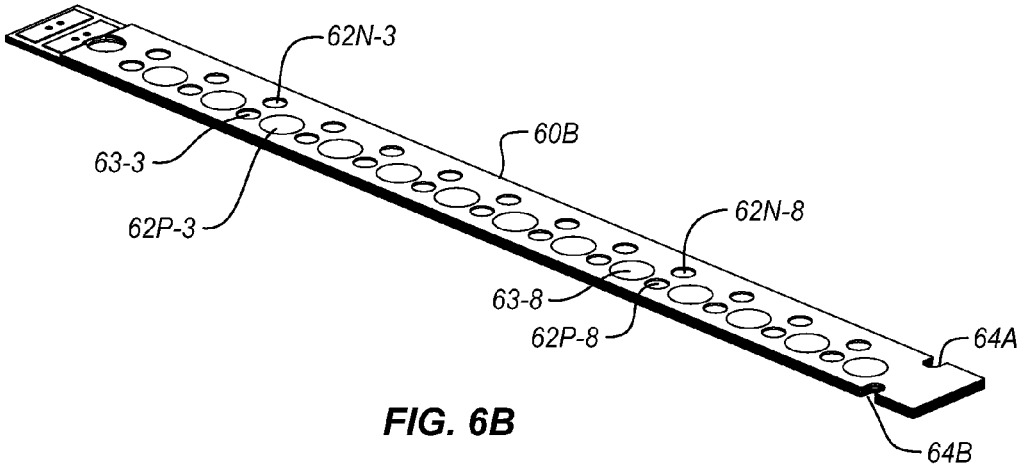
Figure 6C:
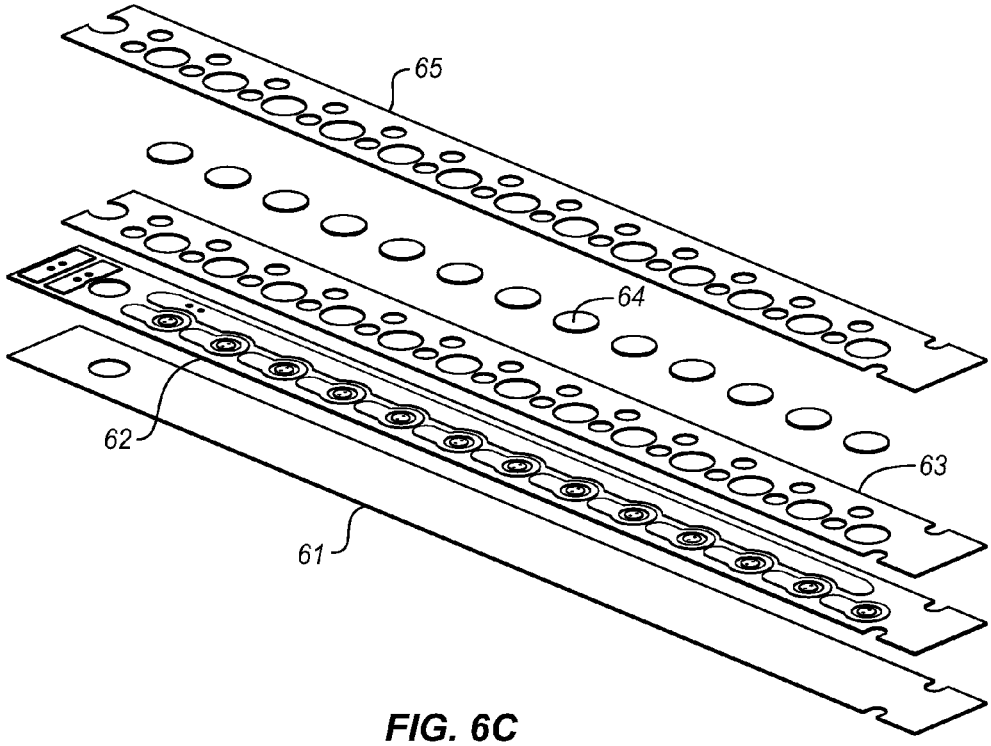
FIG. 6C is an exploded perspective view of a printed circuit board used to implement the Powered Rail.
Figure 8A:
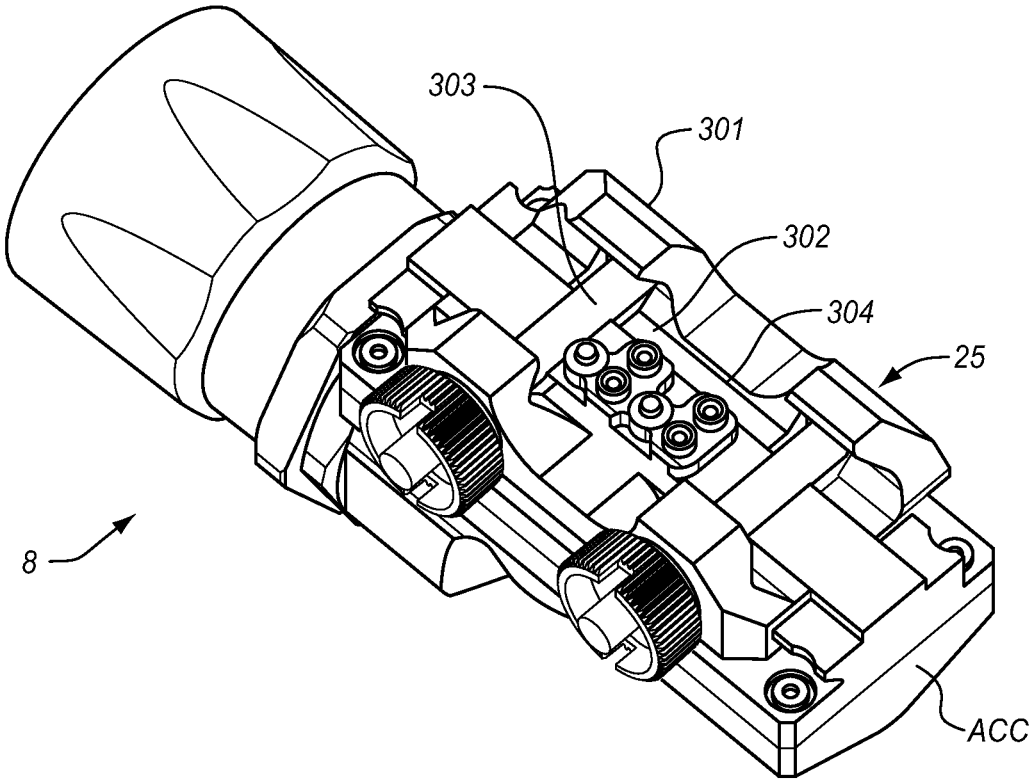
FIGS. 8A-8K are illustrations of the typical mechanical interconnection and electrical interconnection of a Power-Consuming Accessory to the Handguard and Powered Rail using the Weapon Accessory Rail Contacts.
Figure 8C:
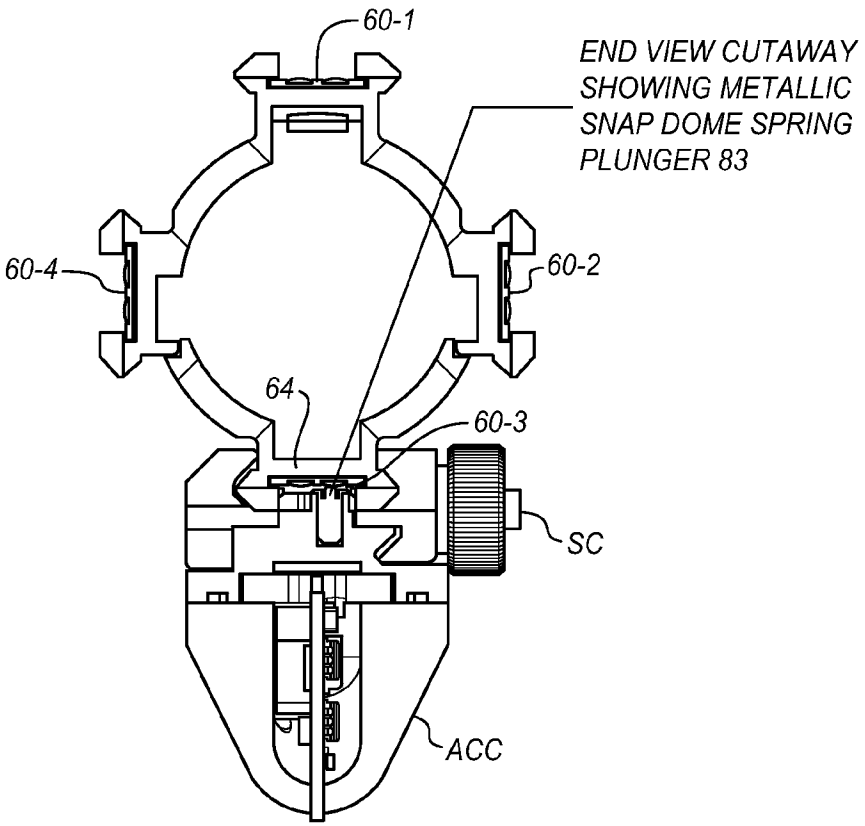
Figure 8B:
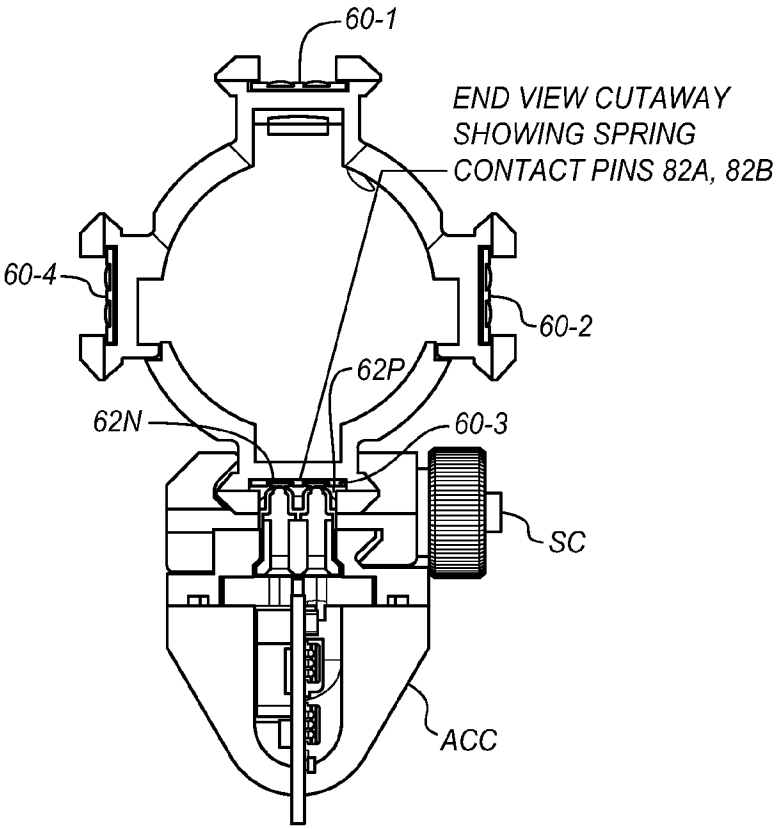

FIGS. 6A and 6B are top views of two versions of the printed circuit board used to implement the Powered Rail 24, and FIG. 6C is an exploded view of the printed circuit board used to implement the Powered Rail 24; FIGS. 7A and 7B illustrate the details of the Powered Rail 24 electrical interconnection; and FIGS. 8A-8C are illustrations of the typical mechanical interconnection and electrical interconnection of a Power-Consuming Accessory to the Handguard 23 and Powered Rail 24.

As noted above, the Powered Rail 24 comprises one or more Printed Circuit Board Assemblies (60-1 to 60-4) which are mounted in the apertures formed in a successive plurality of locking slots on the Powered Rail 24 to carry power to power-consuming accessories which are mounted on the Powered Rail 24 at various locations. The Printed Circuit Boards (60-1 to 60-4) are soldered to electrically conductive busses 72, 74. In addition, a conductive pin connector includes a terminal portion at one end which is pressed into the mating hole (not shown) in the interconnect electrical bus 72. Retaining clips 71 are manufactured from resilient metallic spring material, which are anchored on the upper rail connector 75, and a clamp hook feature 71 of the retaining clip is used to securely hold the lower rail connector 76 by engaging features formed on the lower rail connector 76. FIG. 7B illustrates the retaining clips 71 and electrically conductive busses 72 typically encapsulated in an insulative protective coating. The connector is removable and can be mounted easily through the retaining clips 71 which provide positive retention and a means of securing the connector halves. Mated connector pairs have tab features which captivate the clips.

FIGS. 6A and 6B illustrate the architecture of the printed circuit board used to implement the Printed Circuit Board 62 where remote power is applied via the positive connector contact 61P and the negative connector contact 61N. As shown in FIG. 6A, the power is routed by the electrical traces on the Printed Circuit Board 62. The positive current from positive connector contact 61P is routed to the center of the Printed Circuit Board switch (for example, 63-5) where it is switched via operation of the switch 64 (shown in FIG. 6C) to contact 63P-5, while the negative current from the negative connector contact 61N is routed to the negative bus 62N or negative bus contact pads (for example, 62N-3). The example shown in these figures provided thirteen positions where a power-consuming accessory can be attached and contact the power contacts of the Powered Rail 24. In particular, on both FIGS. 6A and 6B, there are thirteen positive contacts 62P-1 to 62P-13 (only several of which are numbered on the figures to avoid clutter). In FIG. 6A, a continuous negative bus 62N is provided as the other power source connection. In FIG. 6B, the negative power source connections are provided by thirteen individual negative bus contact pads 62N-1 to 62N-13 (only several of which are numbered on the figures to avoid clutter). On the Printed Circuit Board 60A, there are points of attachment, typically comprising notches 64A and 64B, which are used to secure the printed circuit board in place in the corresponding slot of the Powered Rail 24 via a pin clip arrangement.

Figure 10:
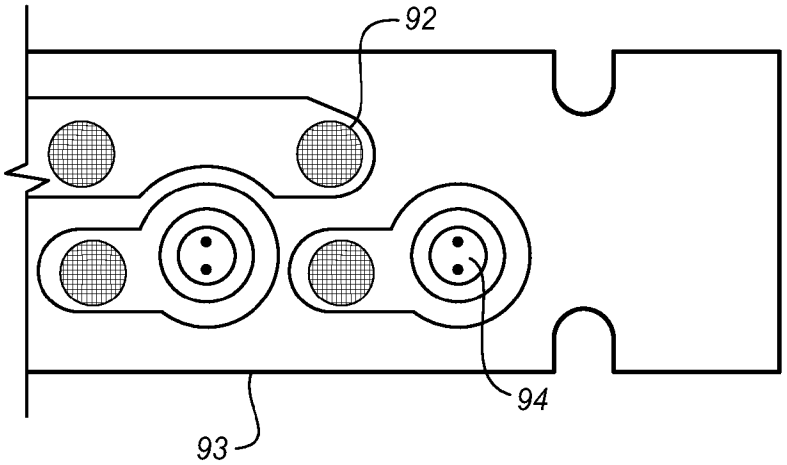
FIG. 10 is an illustration of a Low Reflectivity Contact soldered to a Printed Circuit Board.

The positive 62P-3, 62P-8 (for example) and negative 62N-3, 62N-8 contacts (on FIG. 6B) can be continuously powered, especially in the case where only one set of contacts is provided, or can be switch activated by metallic snap dome switches 63-3, 63-8 which are placed over positive common 94 (as shown in FIG. 10) and are in electrical contact with the accessory positive switched contact 62P-3, 62P-8. The metallic snap dome switch has a pair of conductive contacts which are normally in the open mode; when the cover of the metallic snap dome switch is depressed via a projection on the exterior surface of the power-consuming accessory which is mounted on the Powered Rail 24 juxtaposed to the metallic snap dome switch, these contacts mate and provide an electrical connection between positive common 94 and a positive switched contact 62P as shown in FIG. 10. The metallic snap dome switch is a well-known component and consists of a curved metallic dome that spans two conductors (positive common 94 and a positive switched contact 62P (as shown in FIG. 10) such that when the dome is depressed, it snaps downward to electrically bridge the two conductors. The accessory positive switched contact 62P and the accessory common negative bus contact pad 62N are both implemented using the Low Reflectivity Contact described below.

FIG. 6C illustrates an exploded view of the power distribution Printed Circuit Board assembly where a non-conductive layer 65 prevents the metal weapon Rail from electrically shorting the power distribution Printed Circuit Board 62. Spacer layer 63 is a non-conductive element which holds the snap dome switches in place so they do not move laterally during assembly. Metallic snap dome switches 68 provide the electrical switching action to mounted rail accessories. Top cover layer 65 provides environmental protection to the Printed Circuit Board 62 and the metallic snap dome switches 64 when the aforementioned layers are assembled.

Powered Accessory Mounting

FIGS. 8A-8K are illustrations of the typical mechanical interconnection and electrical interconnection of a power-consuming accessory (such as flashlight 8) to the Handguard 23 and Powered Rail 24 using various embodiments of the Weapon Accessory Rail Contacts. The perspective view of FIG. 8A shows how the Powered Accessory Mounting 25 attaches the power-consuming accessory to the Powered Rail 24 and consists of a rail grabber 301, spring contacts 302, spring plungers 303, and face seals 304. The spring plungers 303 depress the snap-dome switches on the Powered Rail 24, the spring contacts 302 provide electrical contact with the fixed electrical bus contacts 62M and 62P-* on the Powered Rail 24 Printed Circuit Board assembly, and the face seals 304 provide environmental protection.

FIGS. 8B and 8C are cutaway end views of the interconnection of a power-consuming accessory to the Handguard 23 and Powered Rail 24. In particular, the power-consuming accessory and associated Powered Accessory Mounting ACC are mechanically attached to the Handguard 23 in well-known fashion (via screw clamp SC shown here). The Powered Accessory Mounting ACC includes a pair of spring contact pins 82A, 82B which contact corresponding Low Reflectivity Contacts 62N and 62P which are mounted on Printed Circuit Board 60-3. Similarly, the Powered Accessory Mounting ACC includes a spring plunger 303 which contacts corresponding metallic snap dome switch 64 which is mounted on Printed Circuit Board 60-3.

Figure 8D:
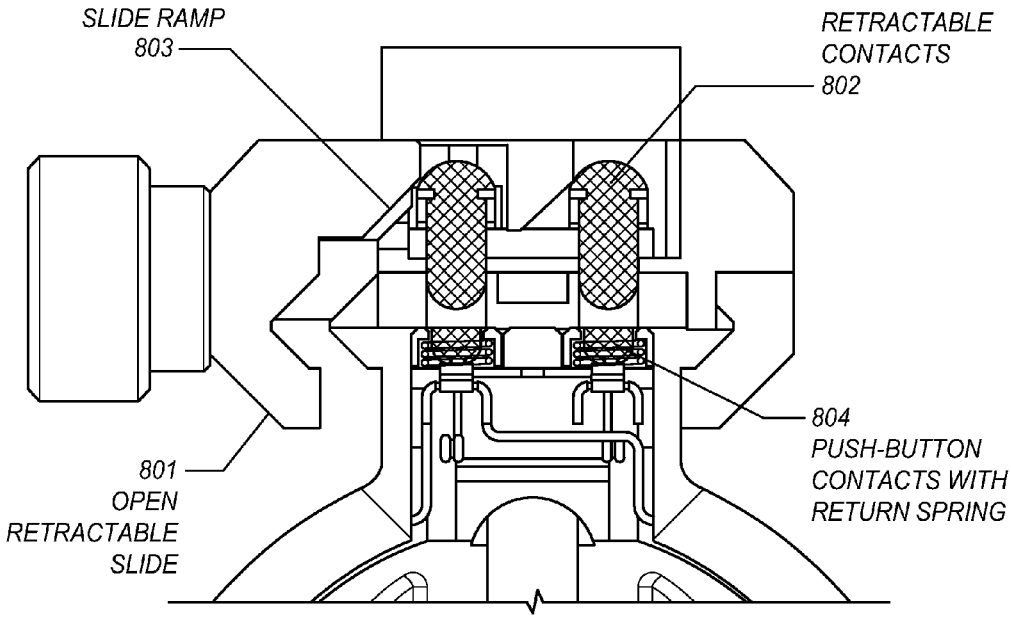
Figure 8E:
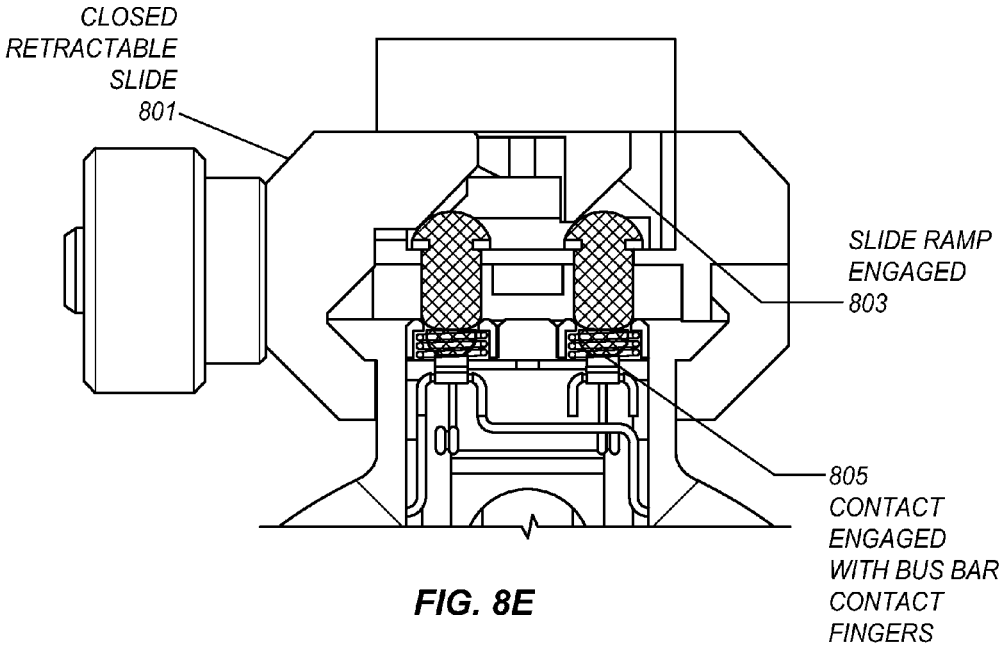

FIGS. 8D and 8E illustrate cutaway end views of an alternative implementation of the interconnection of a power-consuming accessory to the Handguard 23 and Powered Rail 24 using push-button contacts 804 to implement the Weapon Accessory Rail Contacts. FIGS. 8D and 8E show a retracting mounting slide 801 that mounts the power-consuming accessory to the Powered Rail 24. Retractable contacts 802 provide electrical contact with the rail-mounted push-button power contacts 804 on the Powered Rail 24 Printed Circuit Board assembly. Once the retractable contacts 802 have been moved by slide ramp 803, they engage the rail-mounted push-button power contacts 804 and bus bar contact fingers 805.

Figure 8F:
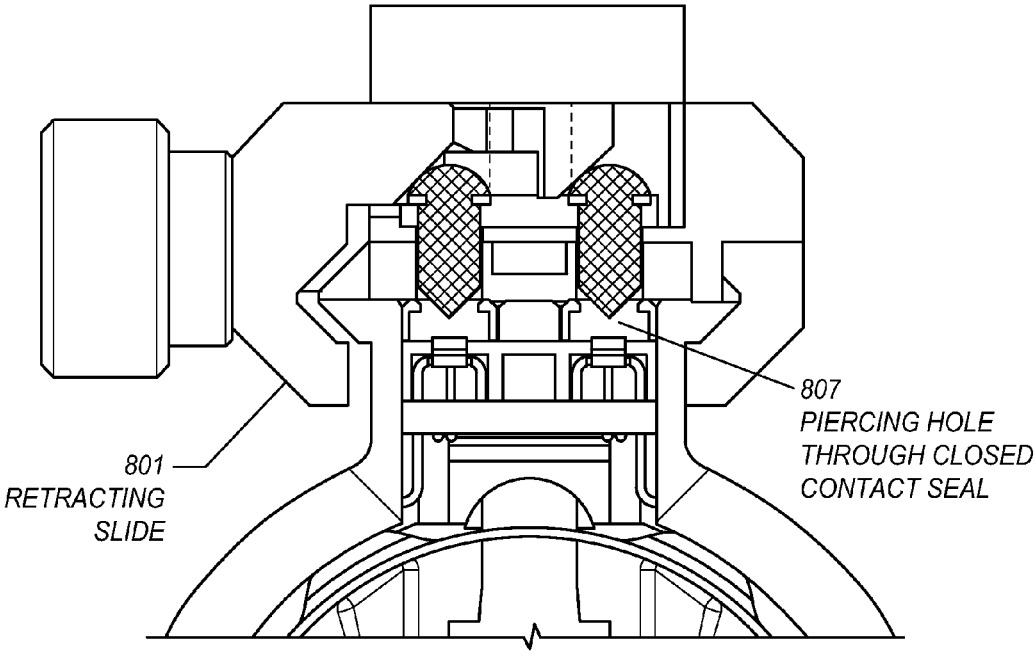
Figure 8G:
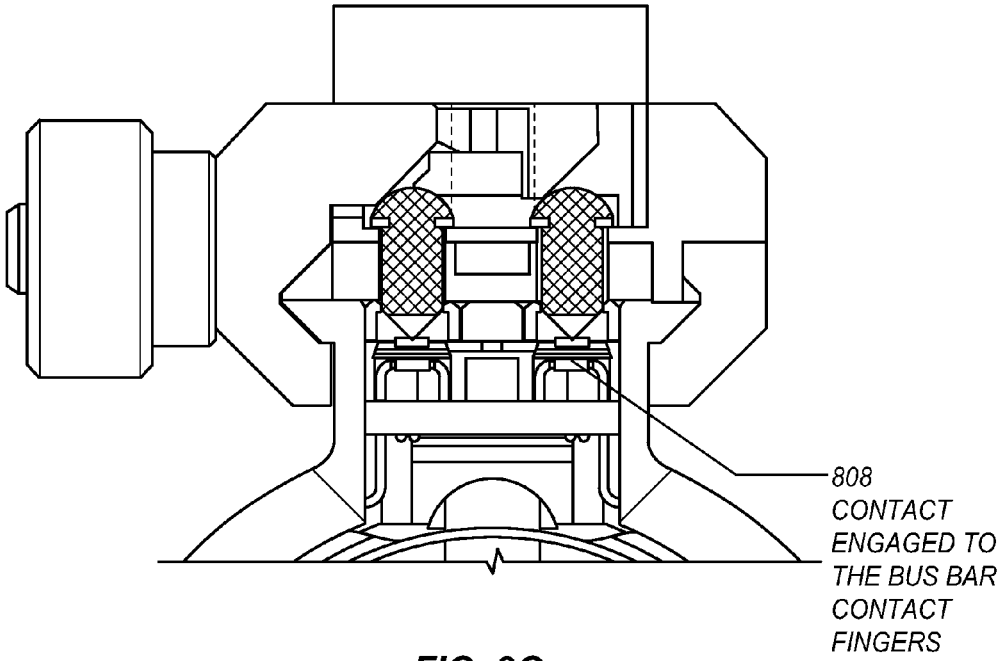

FIGS. 8F and 8G illustrate cutaway end views of an alternative implementation of the interconnection of a power-consuming accessory to the Handguard 23 and Powered Rail 24 using elastomer piercing contacts 806 to implement the Weapon Accessory Rail Contacts. FIGS. 8F and 8G show a retracting mounting slide 801 that mounts the power-consuming accessory to the Powered Rail 24. Electric power is transferred by contacts 806 piercing a non-conductive elastomer 807 due to the force applied by slide ramp 803 when the retracting mounting slide 801 is in the closed position. Once the contacts 806 pierce the elastomer 807, they engage the rail mounted power contacts 808.

Figure 8H:
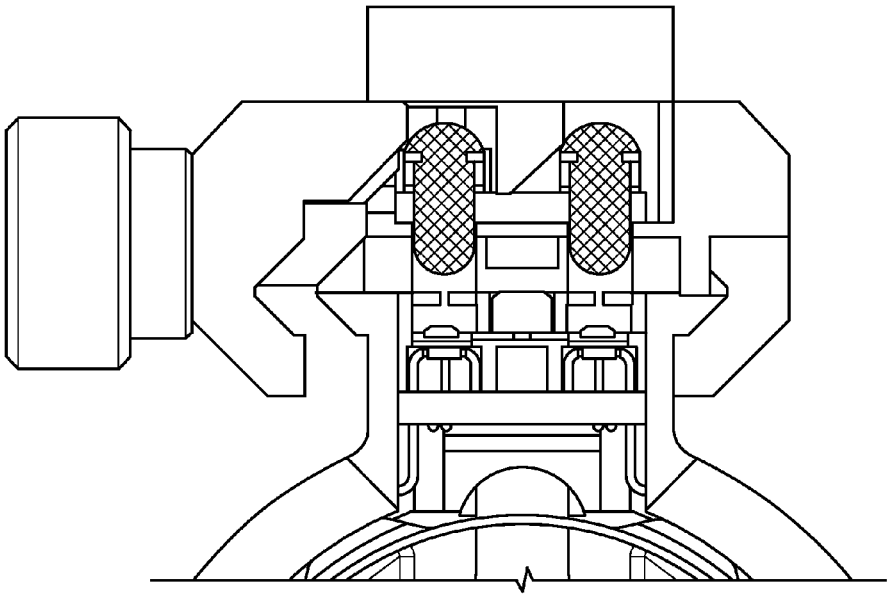
Figure 8I:
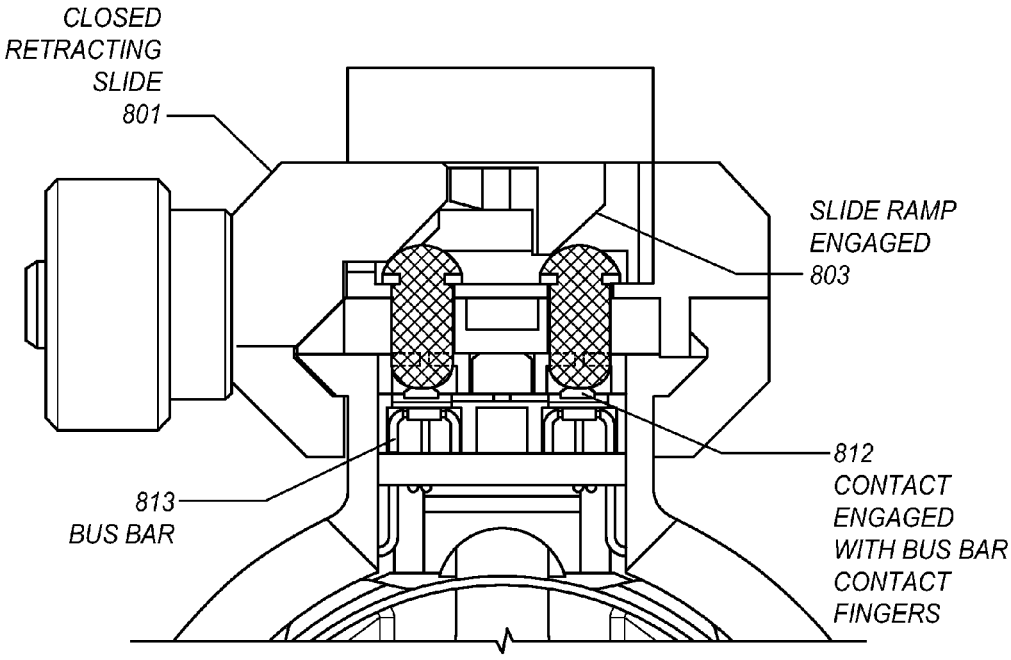

FIGS. 8H and 8I illustrate cutaway end views of an alternative implementation of the interconnection of a power-consuming accessory to the Handguard 23 and Powered Rail 24 using shrouded contacts 810 to implement the Weapon Accessory Rail Contacts. FIGS. 8H and 8I show a retracting mounting slide 801 that mounts the power-consuming accessory to the Powered Rail 24. Electric power is transferred to the power-consuming accessory by shrouded contacts 810. Once the contacts have been acted upon by slide ramp 803, they engage the rail mounted power contacts 812 on bus bar 813.

Figure 8J:
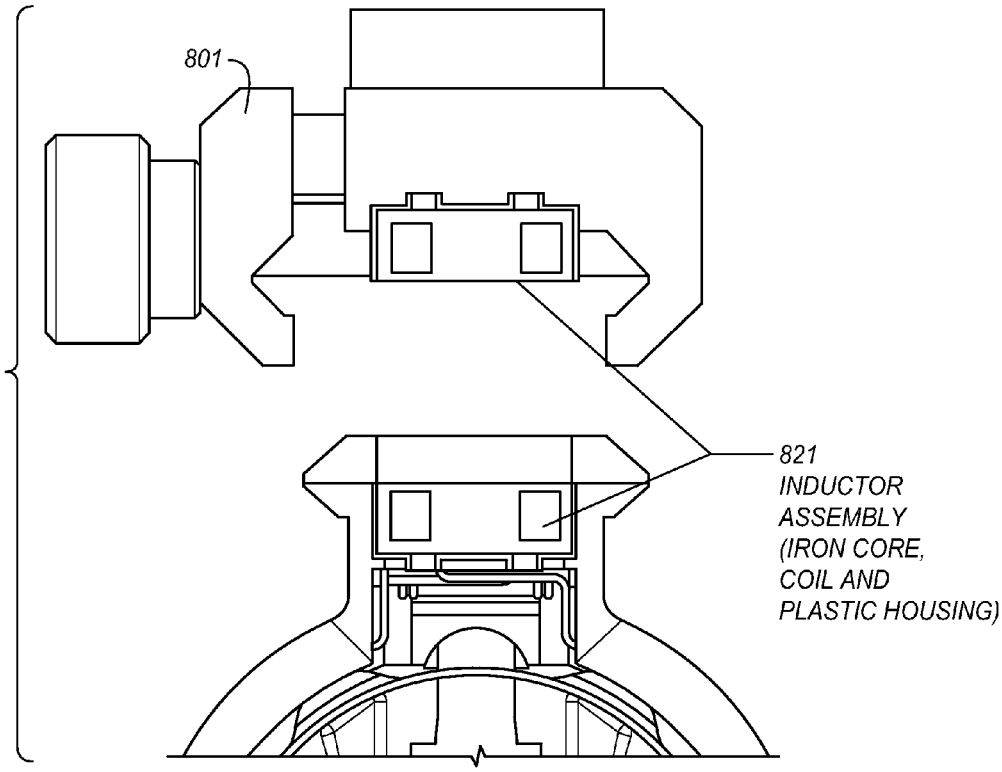
Figure 8K:
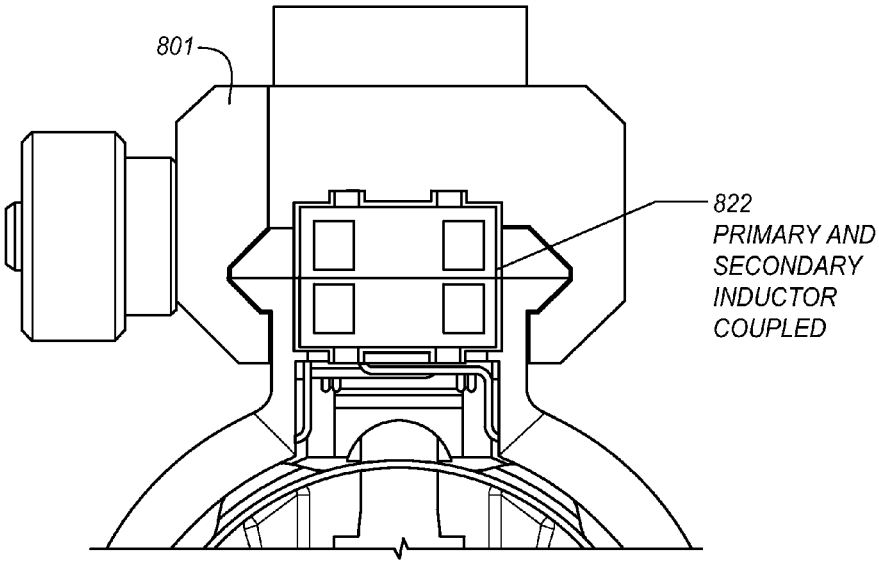

FIGS. 8J and 8K illustrate cutaway end views of an alternative implementation of the interconnection of a power-consuming accessory to the Handguard 23 and Powered Rail 24 using non-mated inductive power coupling to implement the Weapon Accessory Rail Contacts. FIGS. 8J and 8K show two halves of a non-mated inductive power coupling arrangement 821. When the two halves are brought into close proximity, alternating current is passed from the Powered Rail 24 to the power-consuming accessory.

Characteristics of Electrical Contacts and Connectors

An ideal electrical connector has a low contact resistance and high insulation value. It is resistant to vibration, water, oil, and pressure. It is easily mated/unmated, unambiguously preserves the orientation of connected circuits, reliable, and carries one or multiple circuits. Desirable properties for a connector also include easy identification, compact size, rugged construction, durability (capable of many connect/disconnect cycles), rapid assembly, simple tooling, and low cost. No single electrical connector has all of the ideal properties. The proliferation of types of electrical connectors is a reflection of the differing importance placed on the design factors.

From a light reflectivity standpoint, the selection of low resistivity metals to construct the contact contradicts with the goal of achieving low light reflectivity. In particular, gold is highly conductive and makes an excellent choice for a contact, but has a high light reflectivity. If coatings are applied to a gold contact to reduce the light reflectivity, the resistivity of the contact is increased and the coatings quickly wear off in a hostile ambient environment where there are many connect/disconnect cycles. Mechanically modifying the surface of the gold to reduce the flat light reflecting plane presented to incoming visible light also reduces the conductivity of the contact and fails to achieve adequate reductions in light reflectivity reduction. Similar problems are encountered with attempts to alloy gold with other metals.

Characteristics of the Low Reflectivity Contact

Figure 9:
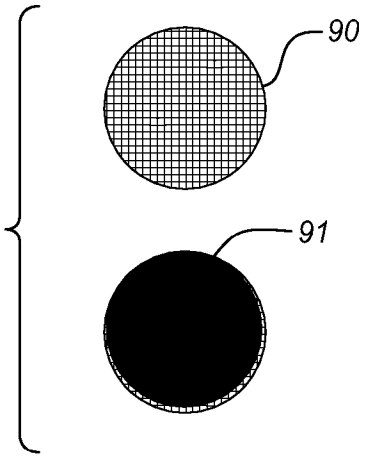
FIG. 9 is a schematic of loose mesh grid disks, plain side up and solder side up, which are used to implement the Low Reflectivity Contact.

FIG. 9 is a schematic of loose mesh contact disks, plain side 90 up and solder side 91 up, which are used to implement the Low Reflectivity Contact version of the Weapon Accessory Rail Contacts; and FIG. 10 is an illustration of a Low Reflectivity Contact 92 soldered to a Printed Circuit Board 93. The Low Reflectivity Contact 92 consists of one Contact of a Contact Pair and is manufactured from a suitable material, with one example being a 400 mesh, alloy 304 Stainless Steel which is woven with a 0.001" thick wire of cylindrical cross-section. The mesh is cut into the desired shape, such as a circle, and one side of the mesh is tinned with solder and soldered on to a Printed Circuit Board (PCB) which is designed to carry power from a power source to the electrical contacts. The other Contact of the Contact Pair consists of a spring loaded contact pin (or lever or any other mechanism to make mechanical contact with the Low Reflectivity Contact) to touch the mesh surface of the Low Reflectivity Contact to provide an electrical connection.

The selection of a wire mesh to implement the electrical contacts is dictated by the need to provide a low light reflectivity characteristic for the exposed electrical contacts. The need for low light reflectivity is important in certain applications, such as military weapons. In addition, the Low Reflectivity Contact provides a target of dimensions which enable the mating Contact of the Contact Pair to complete the circuit connection without the need for precise spatial three-dimensional alignments of the two Contacts of the Contact Pair.

Figure 11B:
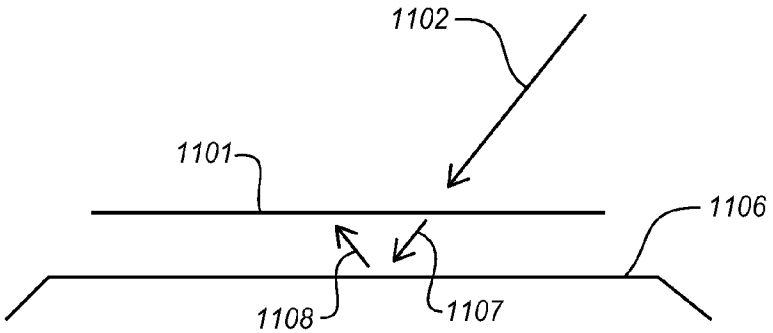
FIGS. 11A and 11B are illustrations of the light reflectivity geometry of the Low Reflectivity Contact.
Figure 11A:
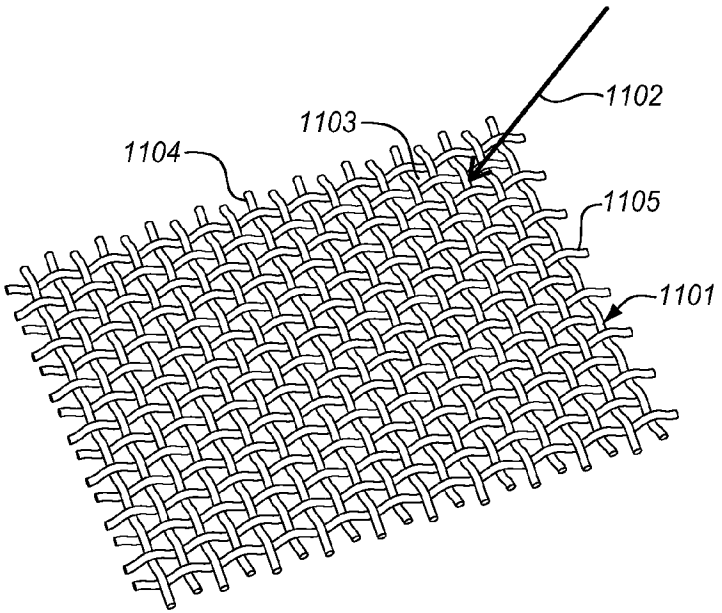

FIGS. 11A and 11B are illustrations of the light reflectivity geometry of the Low Reflectivity Contact. The Low Reflectivity Contact typically comprises a mesh grid 1101 formed of a matrix of electrical wires 1104 and 1105 which are interconnected to form a matrix with apertures 1103 formed in the surface thereof. Alternatively, the mesh grid 1101 can be formed of a sheet of electrically conductive material with apertures 1103 formed in the surface thereof. Incident visible light 1102 (as well as other wavelengths of light) is dispersed by the electric wires 1104, 1105; and only a small fraction of the incident visible light passes through the apertures 1103 of the mesh grid 1101 to the underlying surface 1106, which is typically a conductive pad on the surface of the Printed Circuit Board. The incident light 1107 that passes through the apertures 1103 is reflected 1108 off surface 1106 and strikes the bottom surface of the mesh grid 1101. Therefore, the only way the incident visible light is retransmitted back out of the Low Reflectivity Contacts is for the reflected beam 1108 to pass through an aperture 1103. Thus, by the proper selection of the size of the electric wires 1104, 1105, the density of the wires in the matrix, and the spacing between the mesh grid 1101 and the underlying surface 1106, the size of the apertures and the light reflection path can be managed to substantially eliminate the reflection of visible light off the Low Reflectivity Contact.

Thus, the Low Reflectivity Contact minimizes light reflectivity by the use of a conductive mesh grid which is attached to an underlying conductive surface. The conductive mesh grid comprises a substantially planar structure, typically a matrix of interconnected wires with apertures formed between the intersecting wires, and is used to form the outer surface of the electrical contact. The weave density, weave geometry, and wire diameter of the conductive mesh grid maximizes the attenuation of reflected light in the visible spectrum, yet maintains high electrical conductivity and a lack of sensitivity to contamination via the choice of materials used to implement the Low Reflectivity Contact.

Summary

There has been described Weapon Accessory Rail Contacts for use in a Weapon Accessory Power Distribution System. It should be understood that the particular embodiments shown in the drawings and described within this specification are for purposes of example and should not be construed to limit the invention, which is described in the claims below. Further, it is evident that those skilled in the art may make numerous uses and modifications of the specific embodiment described without departing from the inventive concepts. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

What is claimed as new and desired to be protected by Letters Patent of the United States is:

1. Weapon accessory rail contacts for providing a supply of electrical power for use by at least one power-consuming accessory operatively associated with a weapon, the weapon accessory rail contacts comprising:

a power source;

a power-consuming accessory;

a powered rail, extending along at least a portion of a length of a barrel of a weapon and electrically connected to the power source, wherein the powered rail comprises:

a plurality of mechanical features formed on the outer surface of the powered rail in a parallel, spaced-apart relationship for mechanically positioning the power-consuming accessory, an aperture formed in a plurality of sequential ones of the mechanical features, a circuit board, mounted in the aperture, and which has formed thereon a first electrical contact and a second electrical contact positioned between at least two of the mechanical features for providing a first and a second electrical connection to the power source, respectively, as well as a switch for interconnecting the first electrical contact to the power source, and wherein mechanical mounting of the power-consuming accessory between the two mechanical features activates the switch and electrically connects the power-consuming accessory to the first and the second electrical contacts;

wherein the power-consuming accessory has first and second electrical contacts positioned to mate with the first electrical contact and the second electrical contact formed on the circuit board, respectively, for electrically connecting the power-consuming accessory to the powered rail.

2. The weapon accessory rail contacts of claim 1 wherein the power-consuming accessory first and second electrical contacts comprise:

first and second contacts extending from a bottom surface of the power-consuming accessory to engage corresponding dome spring contacts formed on an exposed surface of the circuit board for completing the first and second electrical connections to the power source in response to the power-consuming accessory being mounted on the powered rail.

3. The weapon accessory rail contacts of claim 1 wherein the power-consuming accessory first and second electrical contacts comprise:

first and second contacts extending from a bottom surface of the power-consuming accessory to engage corresponding covered contacts formed on an exposed surface of the circuit board for completing the first and second electrical connections to the power source in response to the power-consuming accessory being mounted on the powered rail.

4. The weapon accessory rail contacts of claim 1 wherein the power-consuming accessory first and second electrical contacts comprise:

first and second piercing contacts extending from a bottom surface of the power-consuming accessory to pierce an elastomer coating which encapsulates electrical contacts formed on an exposed surface of the circuit board for completing the first and second electrical connections to the power source in response to the power-consuming accessory being mounted on the powered rail.

5. The weapon accessory rail contacts of claim 1 wherein the power-consuming accessory first and second electrical contacts comprise:

terminals of an inductive coupling circuit to wirelessly receive power from a corresponding inductive coupling power source mounted on the powered rail and positioned under the power-consuming accessory.

6. Weapon accessory rail contacts for providing a supply of electrical power for use by one or more power-consuming accessories operatively associated with the weapon, the weapon accessory rail contacts comprising:

a power source;

a power-consuming accessory;

a powered rail, incorporated in a handguard which extends along at least a portion of a length of a barrel of a weapon, and electrically connected to the power source, wherein the powered rail comprises:

a plurality of mechanical features formed on the outer surface of the powered rail in a parallel, spaced-apart relationship for mechanically positioning the power-consuming accessory, an aperture formed in a plurality of sequential ones of the mechanical features, a circuit board, mounted in the aperture, and which has formed thereon a first electrical contact and a second electrical contact positioned between at least two of the mechanical features for providing a first and a second electrical connection to the power source, respectively, as well as a switch for interconnecting the first electrical contact to the power source, and wherein mechanical mounting of the power-consuming accessory between the two mechanical features activates the switch and electrically connects the power-consuming accessory to the first and the second electrical contacts;

wherein the power-consuming accessory has first and second electrical contacts positioned to mate with the first electrical contact and the second electrical contact formed on the printed circuit board, respectively, for electrically connecting the power-consuming accessory to the powered rail.

7. The weapon accessory rail contacts of claim 6 wherein the power-consuming accessory first and second electrical contacts comprise:

first and second contacts extending from a bottom surface of the power-consuming accessory to engage corresponding dome spring contacts formed on an exposed surface of the circuit board for completing the first and second electrical connections to the power source in response to the power-consuming accessory being mounted on the powered rail.

8. The weapon accessory rail contacts of claim 6 wherein the power-consuming accessory first and second electrical contacts comprise:

first and second contacts extending from a bottom surface of the power-consuming accessory to engage corresponding covered contacts formed on an exposed surface of the circuit board for completing the first and second electrical connections to the power source in response to the power-consuming accessory being mounted on the powered rail.

9. The weapon accessory rail contacts of claim 6 wherein the power-consuming accessory first and second electrical contacts comprise:

first and second piercing contacts extending from a bottom surface of the power-consuming accessory to pierce an elastomer coating which encapsulates electrical contacts formed on an exposed surface of the circuit board for completing the first and second electrical connections to the power source in response to the power-consuming accessory being mounted on the powered rail.

10. The weapon accessory rail contacts of claim 6 wherein the power-consuming accessory first and second electrical contacts comprise:

terminals of an inductive coupling circuit to wirelessly receive power from a corresponding inductive coupling power source mounted on the powered rail and positioned under the power-consuming accessory.

* * * * *